US007766680B2

(12) United States Patent
Suzuki et al.

(10) Patent No.: US 7,766,680 B2
(45) Date of Patent: Aug. 3, 2010

(54) FLEXIBLE CIRCUIT BOARD CONNECTOR

(75) Inventors: Masayuki Suzuki, Tokyo (JP); Osamu Koyasu, Tokyo (JP)

(73) Assignee: DDK Ltd., Tokyo (JP)

( * ) Notice: Subject to any disclaimer, the term of this patent is extended or adjusted under 35 U.S.C. 154(b) by 43 days.

(21) Appl. No.: 12/205,834

(22) Filed: Sep. 5, 2008

(65) Prior Publication Data

US 2009/0068860 A1 Mar. 12, 2009

(30) Foreign Application Priority Data

Sep. 7, 2007 (JP) ..... 2007-232441

(51) Int. Cl.
*H01R 13/15* (2006.01)

(52) U.S. Cl. ..... 439/260; 439/492; 439/495

(58) Field of Classification Search ..... 439/260, 439/492, 494, 495, 499
See application file for complete search history.

(56) References Cited

U.S. PATENT DOCUMENTS

| | | | | |
|---|---|---|---|---|
| 7,044,733 | B2 * | 5/2006 | Schendell-Groling | 433/3 |
| 7,083,454 | B2 * | 8/2006 | Suzuki | 439/260 |
| 7,223,110 | B2 * | 5/2007 | Suzuki et al. | 439/260 |
| 7,311,542 | B2 * | 12/2007 | Suzuki | 439/260 |
| 7,393,239 | B2 * | 7/2008 | Suzuki et al. | 439/495 |
| 7,435,122 | B2 * | 10/2008 | Suzuki et al. | 439/260 |
| 7,448,893 | B2 * | 11/2008 | Suzuki | 439/260 |
| 7,491,088 | B2 * | 2/2009 | Suzuki et al. | 439/607.01 |
| 7,494,366 | B2 * | 2/2009 | Suzuki et al. | 439/495 |
| 7,540,764 | B2 * | 6/2009 | Suzuki et al. | 439/495 |
| 7,563,128 | B2 * | 7/2009 | Suzuki et al. | 439/495 |
| 7,591,661 | B2 * | 9/2009 | Suzuki et al. | 439/260 |
| 2006/0042816 | A1 * | 3/2006 | Sakurai et al. | 174/88 R |
| 2007/0178751 | A1 * | 8/2007 | Yamamoto | 439/495 |

FOREIGN PATENT DOCUMENTS

| | | |
|---|---|---|
| JP | 2004-206987 | 7/2004 |
| JP | 2004-221067 | 8/2004 |
| JP | 2006-147271 | 6/2006 |
| JP | 2007-184097 | 7/2007 |

* cited by examiner

*Primary Examiner*—Edwin A. Leon
*Assistant Examiner*—Vanessa Girardi
(74) *Attorney, Agent, or Firm*—Sughrue Mion, PLLC

(57) ABSTRACT

A connector device to be used with a flexible printed circuit board including a connector. The flexible printed circuit board has on its front and rear surfaces ground patterns, signal patterns and phase inversion signal patterns arranged such that the signal pattern and the phase inversion signal pattern are arranged between the two ground patterns, and has a ground layer between the front and rear surfaces and exposed portions located at predetermined positions and reaching the ground layer. The connector has first and second contacts of two kinds. The first and second contacts are arranged in one and the same inserting hole of the housing such that their contact portions are opposite to each other. When a pivoting member has been pivotally moved, the first and second contacts come into contact with the corresponding ground, signal and phase inversion signal patterns on the flexible printed circuit board and the members at the predetermined positions enter the exposed portions so as to contact the ground layer, thereby achieving a miniaturization of the connector and high speed transmission of signals.

16 Claims, 17 Drawing Sheets

FLEXIBLE CIRCUIT BOARD CONNECTOR

BACKGROUND OF THE INVENTION

This invention relates to a connector device for use in electric and electronic appliances such as mobile or cellular phones, notebook personal computers, digital cameras, and the like, and more particularly to a connector device with a structure achieving a miniaturization of the connector (high density of conductors) and at the same time high speed transmission of signals by causing respective contacts to come into contact with contact portions of a flexible printed circuit board and simultaneously causing members to be in contact with a ground layer arranged between a front and a rear surface of the flexible printed circuit board by pivotal movement of a pivoting member after the flexible printed circuit board has been inserted into the connector.

A connector generally comprises at least a plurality of contacts, a housing for arranging and holding the contacts, and a pivoting member mounted on the housing for causing the contacts to be elastically deformed so as to be in contact with a connecting object by means of a pivotal movement of the pivoting member. The contacts each have a contact portion adapted to contact the connecting object and a connection portion to be connected to a substrate. The housing has a required number of inserting holes for receiving the contacts and a fitting opening into which the connecting object (a flexible printed circuit board, flexible flat cable, or the like) is inserted. The pivoting member is provided with pushing portions for causing the contacts to be elastically deformed.

Incorporated hereinafter are Japanese Patent Application Opened No. 2004-71,160 (Patent Literature 1) disclosing a rear locking type connector, Japanese Patent Application Opened No. 2004-206,987 (Patent Literature 2) disclosing a feature of two contacts inserted in one and the same inserting hole of a housing, and Japanese Patent Application Opened No. 2004-221,067 (Patent Literature 3) and Japanese Patent Application Opened No. 2006-147,271 (Patent Literature 4) both disclosing connectors using locking members having a construction of the same as that of contacts of rear locking type, these applications being proposed by the applicant of the present application. Moreover, incorporated herein is Japanese Patent Application No. 2007-184,097 (Patent Literature 5) which is an improvement in the invention of the Patent Literature 2.

Patent Literature 1

According to the abstract of the Japanese Patent Application Opened No. 2004-71,160, this invention has an object to provide a connector being capable of securely pushing a flexible printed circuit board 40 or flexible flat cable to contact portions 22 of contacts 14 by means of a slider 16 without degrading strengths of respective members and specifications or customers demands, and achieving a superior operationality, narrower pitches of conductors and a reduced overall height. Disclosed is a connector comprising contacts 14 each having a contact portion 22, a connection portion 24, and an elastic portion 34 and a fulcrum portion 32 between the contact portion 22 and the connection portion 24, and a pressure receiving portion 20 extending from the elastic portion 34 in a position facing to the connection portion 24, and the contact portion 22, elastic portion 34, fulcrum portion 32 and connection portion 24 being arranged in the form of a crank, and a slider 16 comprising pushing portions 36 arranged continuously in the longitudinal direction and the slider 16 being pivotally mounted on a housing 12 so that the pushing portions 36 are pivotally movable between the connection portions 22 and pressure receiving portions 20 of the contacts 14.

By the way, claim 1 of the Japanese Patent Application Opened No. 2004-71,160 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting said flexible printed circuit board or flexible flat cable, and a slider for pushing said flexible printed circuit board or flexible flat cable to said contacts, wherein said contacts each comprise an elastic portion and a fulcrum portion between the contact portion and a connection portion, and a pressure receiving portion extending from said elastic portion and located in a position facing to said connection portion, and said contact portion, said elastic portion, said fulcrum portion and said connection portion being arranged substantially in the form of a crank, and said slider is provided with pushing portions arranged continuously in its longitudinal direction and is mounted on said housing so that said pushing portions are pivotally movable between the connection portions and the pressure receiving portions of said contacts. Claim 2 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting said flexible printed circuit board or flexible flat cable, and a slider for pushing said flexible printed circuit board or flexible flat cable to said contacts, wherein two kinds of contacts are arranged to be alternately staggered, the contacts of one kind each comprising an elastic portion and a fulcrum portion between the contact portion and a connection portion, and a pressure receiving portion extending from said elastic portion in a position facing to said connection portion, and said contact portion, said elastic portion, said fulcrum portion and said connection portion being arranged substantially in the form of a crank, and the contacts of the other kind each comprising an elastic portion and a fulcrum portion between the contact portion and a connection portion, and a pressure receiving portion extending from said elastic portion in the opposite direction from the contact portion, and said contact portion, said elastic portion, said fulcrum portion, and said connection portion being arranged substantially in the form of a U-shape, and wherein said slider is provided with pushing portions arranged continuously in its longitudinal direction and mounted on said housing so that said pushing portions are pivotally movable between the connection portions and the pressure receiving portions of the contacts of the one kind and between the pressure receiving portions of the contacts of the other kind and said housing. Claim 3 recites the connector claimed in claim 1, wherein when the pushing portions of said slider are pivotally moved between the connection portions and the pressure receiving portions of said contacts of the one kind, said pressure receiving portions are raised by the pushing portions so that said elastic portions are tilted about said fulcrum portions toward said contact portions to push said contact portions against said flexible printed circuit board or flexible flat cable. Claim 4 recites the connector claimed in claim 1 or 2, wherein the pressure receiving portions of said contacts of the one kind or the other kind are each provided at the tip with an extended portion so that the pushing portions of said slider are prevented from moving toward the connection portions of said contacts of the one kind. Claim 5 recites the connector claimed in claim 1 or 2, wherein the pushing portions of said slider are of an elongated shape. Claim 6 recites the connector claimed in claim 5, wherein said slider is formed with a required number of anchoring holes independent from one another, which are adapted to engage the extended portions of said contacts, respectively. Claim 7 recites the connector claimed in claim 5, wherein the elongated shape of said pushing portions is elliptical. Claim 8 recites the connector claimed in claim 1, wherein said contacts of the one kind are each provided with a further contact portion at a location extending from the fulcrum portion and adapted to contact said flexible printed circuit board or flexible flat cable. Claim 9 recites the connector claimed in claim 2, wherein said contacts of the other kind are each provided with an extension portion extending from said fulcrum in the opposite direction from the connection portion, and said slider is mounted on said housing so that the pushing portions of said slider are pivotally movable between the extension portions and the pressure receiving portions. Claim 10 recites the connector claimed in claim 2, wherein said contacts of the other kind are each further provided between the fulcrum portion and the connection portion with a contact portion adapted to contact said flexible printed circuit board or flexible flat cable.

Patent Literature 2

According to the abstract of the Japanese Patent Application Opened No. 2004-206,987, this invention has an object to provide a connector enabling narrow pitches and being used with a flexible printed circuit board having contact portions on both surfaces. Disclosed is a connector including a required number of contacts each having a contact portion 52 adapted to contact a flexible printed circuit board 22, and a housing 12 for holding and fixing the contacts and having a fitting opening 24 for inserting the flexible printed circuit board 22, wherein when the flexible printed circuit board 22 has contact portions 52 on both front and rear surfaces, contacts 14 and 16 of two kinds are used in a manner such that the contacts 14 of one kind are inserted into the housing from the opposite side of the fitting opening 24 so as to permit their contact portions 30 to contact the contact portions 52 on the front surface of the circuit board 22, and the contacts 16 of the other kind are inserted into the housing 12 from the side of the fitting opening 24 so as to permit their contact portions 20 to contact the contact portions 52 on the rear surface of the circuit board 22.

By the way, claim 1 of the Japanese Patent Application Opened No. 2004-206,987 recites a connector detachably fitted with a flexible printed circuit board (FPC) including a required number of contacts each having a contact portion adapted to contact said flexible printed circuit board, a housing holding and fixing said contacts and having a fitting opening for inserting the flexible printed circuit board, wherein when the flexible printed circuit board has contact portions on both front and rear surfaces, contacts of two kinds are used in a manner such that the contacts of one kind are inserted into the housing from the opposite side of the fitting opening so as to permit their contact portions to contact the contact portions on the front surface of the circuit board, and the contacts of the other kind are inserted into the housing from the side of the fitting opening so as to permit their contact portions to contact the contact portions on the rear surface of the circuit board. Claim 2 recites the connector claimed in claim 1, wherein a pair of contacts are formed by two contacts of the two kinds and arranged so that their contact portions are facing to each other so as to embrace said flexible printed board by the opposite contact portions of the respective pairs. Claim 3 recites the connector claimed in claim 2, wherein the contact portions of the pairs of contacts are staggered with respect to the longitudinal direction. Claim 4 recites the connector claimed in claim 3, wherein said housing is provided with a recess on the side of said fitting opening for conducting said flexible printed circuit board, and the contacts of the other kind are arranged such that their connection portions do not extend from the recess of said housing. Claim 5 recites the connector claimed in claim 4, wherein in order to form a zero insertion-force (ZIF) structure which does not require a force when said flexible printed circuit board is inserted into the housing, a slider is used which is pushed against the contacts after said flexible printed circuit board has been inserted into the housing. Claim 6 recites the connector claimed in claim 5, wherein the contacts of the one kind each include an elastic portion and a fulcrum portion between the contact portion and the connection portion, and a pressure receiving portion extending from said elastic portion at a location facing to said connection portion, and said contact portion, said elastic portion, said fulcrum portion, and said connection portion being substantially in the form of a crank, and the contacts of the other kinds each include a contact portion and a connection portion and are so arranged that their connection portions are in the recess of said housing, and wherein said slider is provided with pushing portions arranged continuously in its longitudinal direction and said slider is mounted on said housing so as to permit said pushing portions to be pivotally movable between the connection portions and the pressure receiving portions of the contacts of the one kind.

Patent Literature 3

According to the abstract of the Japanese Patent Application Opened No. 2004-221,067, the object of this invention is to provide a connector 10 ensuring a required holding force for a flexible printed circuit board 22 without any defective or failed connection even with less conductors. Disclosed is a connector 10 detachably fitted with a flexible printed circuit board 22, including a required number of contacts 14 each having a contact portion 30 adapted to contact the flexible printed circuit board 22, and a housing 12 holding and fixing the contacts 14 and having a fitting opening 24 into which the flexible printed circuit board 22 is inserted, wherein the circuit board 22 is provided with anchoring portions 54, and locking members 20 each having an engaging portion 56 adapted to engage said anchoring portion 54 of the circuit board are installed into the housing 12 so that the engaging portions 56 of the locking members 20 are caused to engage the anchoring portions 54 of the circuit board 22, thereby preventing the circuit board 22 from being removed from the housing 12, and wherein grooves 57 are provided at positions corresponding to said engaging portions 56 to ensure a more reliable locking.

By the way, claim 1 of the Japanese Patent Application Opened No. 2004-221,067 recites a connector detachably fitted with a flexible printed circuit board, including a required number of contacts each having a contact portion to contact said flexible printed circuit board, and a housing holding and fixing the contacts and having a fitting opening into which said flexible printed circuit board is inserted, wherein said flexible printed circuit board is provided with anchoring portions, and locking members each having an engaging portion adapted to engage said anchoring portion of said circuit board are installed in said housing so that the engaging portions of said locking members are caused to engage the anchoring portions of said circuit board, thereby preventing the circuit board from being removed from said housing. Claim 2 recites the connector claimed in claim 1, wherein grooves are provided at locations facing to said engaging portions. Claim 3 recites the connector claimed in claim 1 or 2, wherein said locking members are each provided with a connection portion for connecting to the circuit board so that the connection portions serve to fix the locking members to the circuit board. Claim 4 recites the connector claimed in claim 1 or 2, wherein in order to form a zero insertion-force (ZIF) structure which does not require a force when said flexible printed circuit board is inserted into the fitting opening of said housing, a slider is used which pushes said flexible printed circuit board against said contacts after said flexible printed circuit board has been inserted into the housing, and the engaging portions of said locking members are caused to engage the anchoring portions of said flexible printed circuit board when the circuit board is pushed against said contacts by said slider. Claim 5 recites the connector claimed in any one of claims 2, 3 and 4, wherein said grooves are provided in a manner such that flat portions of said engaging portions engage said anchoring portions when the engaging portions of said locking portions engage the anchoring portions of said flexible printed circuit board. Claim 6 recites the connector claimed in claim 5, wherein said housing is provided on the side of said fitting opening with a recess for conducting said flexible printed circuit board, and said contacts are so arranged in said housing that the connection portions of said contacts do not extend out of the recess of said housing. Claim 7 recites the connector claimed in claim 6, wherein contacts of two kinds are arranged to be staggered so that connection portions of the contacts of the one kind are arranged on the opposite side of the fitting opening of said housing, and connection portions of the contacts of the other kind and of said locking members are arranged so as not to extend from the recess of said housing. Claim 8 recites the connector as claimed in claim 7, wherein the contacts of the one kind each comprise an elastic portion and a fulcrum portion between the contact portion and the connection portion, and an extension portion extending from said elastic portion at a location facing to said connection portion, and said contact portion, said elastic portion, said fulcrum portion, and said connection portion being arranged substantially in the form of a crank, wherein the contacts of the other kind each comprise an elastic portion and a fulcrum portion between the contact portion and the connection portion, a pressure receiving portion extending from said elastic portion in the opposite direction from the contact portion, and an extension portion extending from said fulcrum portion to be facing to the pressure receiving portion, and said contact portion, said elastic portion, said fulcrum portion, and said connection portion being arranged substantially in the form of a U-shape, and the contacts of the other kind are arranged so that said connection portions are within the recess of said housing, and wherein said slider is provided with pushing portions arranged continuously in its longitudinal direction, and said slider is mounted on said housing so that said pushing portions are pivotally movable between the connection portions and the pressure receiving portions of the contacts of the one kind and between the pressure receiving portions and the extension portions of the contacts of the other kind. Claim 9 recites the connector claimed in claim 8, wherein said locking members are the same in construction as the contacts of the other kind.

Patent Literature 4

According to the abstract of the Japanese Patent Application Opened No. 2006-147,271, this invention has an object to provide a connector ensuring a stable holding force for a flexible printed circuit board, even the connector having a small number of conductors, without causing defective or failed connection, and achieving a more reduced overall height of the connector. Disclosed is a connector for achieving this object, wherein a flexible printed circuit board 80 is provided with anchoring portions 82, and locking members each include a first piece 20 having at one end an engaging portion 24 adapted to engage the anchoring portion 82, at the other end a pressure receiving portion 26 to be pushed by a pivoting member, and an extended portion 34 inwardly extending from the tip of the pressure receiving portion 26, a second piece 22 having at one end a connection portion 30 to be connected to a substrate, and a jointing fulcrum portion 32 for jointing the first piece 20 and the other end of the second piece 22, and wherein the locking members are installed in the housing 12 so that when the pivoting member 16 is pivotally moved to cause the engaging portions 24 of the locking members 18 to engage the anchoring portions 82 of the flexible printed circuit board 82, there are no second pieces 22 at locations facing to the engaging portions 24, and the housing 12 is provided with notches 42 at locations corresponding to the locking members 18.

By the way, claim 1 of the Japanese Patent Application Opened No. 2006-147,271 recites a connector detachably fitted with a flexible printed circuit board (FPC), including a plurality of contacts each having a contact portion adapted to contact said flexible printed circuit board, a housing holding and fixing said contacts and having a fitting opening into which said flexible printed circuit board is inserted, locking members adapted to engage said flexible printed circuit board, and a pivoting member for elastically deforming said contacts and said locking members, wherein said flexible printed circuit board is provided with anchoring portions, and said locking members each comprise a first piece having at one end an engaging portion adapted to engage said anchoring portion, at the other end a pressure receiving portion to be pushed by said pivoting member, and an extended portion extending inwardly from a tip of said pressure receiving portion, a second piece having at one end or the other end a connection portion to be connected to a substrate, and a jointing fulcrum portion for jointing said first piece and the other end or one end of said second piece, and wherein said locking members are installed in said housing, and said housing is provided with notches at locations corresponding to said locking members on the side of the upper surface of said housing. Claim 2 recites a connector detachably fitted with a flexible printed circuit board (FPC), including a plurality of contacts each having a contact portion adapted to contact said flexible printed circuit board, a housing holding and fixing said contacts and having a fitting opening into which said flexible printed circuit board is inserted, locking members adapted to engage said flexible printed circuit board, and a pivoting member for elastically deforming said contacts and said locking members, wherein said flexible printed circuit board is provided with anchoring portions, and said locking members each comprise a first piece having at one end an engaging portion adapted to engage said anchoring portion, at the other end a pressure receiving portion to be pushed by said pivoting member, and an extended portion extending inwardly from a tip of said pressure receiving portion, a second piece having at one end a connection portion to be connected to a substrate, and a jointing fulcrum portion for jointing said first piece and the other end of said second piece, and wherein said locking members are installed in said housing, and when said pivoting member is pivotally moved to cause the engaging portions of said locking members to engage the anchoring portions of said flexible printed circuit board, there are not said second pieces at locations facing to said engaging portions. Claim 3 recites the connector claimed in claim 2, wherein the height of said second pieces is 0.08 to 0.12 mm. Claim 4 recites the connector claimed in claim 2 or 3, wherein said second pieces are each provided with an extension portion extending from said jointing fulcrum portion in a direction so as to face to said engaging portion, said extension portion being shorter than the engaging portion of said first piece so that the extension portion does not come to a position facing to said engaging portion when said pivoting member is pivotally moved to cause the engaging portions of said locking members to engage the anchoring portions of said flexible printed circuit board. Claim 5 recites the connector claimed in claim 4, wherein the locking members are each provided with a fixing portion between the tip of the extension portion of said second piece and said jointing fulcrum portion. Claim 6 recites the connector claimed in any one of claims 1 to 5, wherein said contacts each comprise a first piece having at one end a contact portion adapted to contact said flexible printed circuit board, at the other end a pressure receiving portion to be pushed by said pivoting member, and an extended portion inwardly extending from the tip of said pressure receiving portion, a second piece having at one end a connection portion to be connected to a substrate and at the other end an extension portion extending from a fulcrum portion, and a jointing portion for jointing said first piece and the fulcrum portion of said second piece, and said contact portion, said jointing portion, said fulcrum portion, and said connection portion being arranged substantially in the form of a U-shape, and, wherein said pivoting member comprises an actuating member for pivotally moving it, pushing portions provided continuously in the longitudinal direction, and anchoring holes for receiving the pressure receiving portions of said contacts and said locking members, and said pivoting member is mounted on said housing so that said pushing portions are pivotally movable between the pressure receiving portions and the extension portions of said contacts and between the pressure receiving portions and the connection portions of said locking members.

Patent Literature 5

According to the abstract of the Japanese Patent Application No. 2007-184,097, this invention has an object to provide a connector having a construction which prevents the contacts from being warped or deformed when the pivoting member is being pivotally moved, and achieves a stable electrical connection, a reduced overall height of the connector and a high density of the conductors. Disclosed is a connector including first and second contacts of which one first contact 14 and one second contact 15 are inserted into one and the same inserting hole 38 of a housing 12 such that contact portions 22 of the first and second contacts are facing to each other, the first contacts 14 each including the contact portion 22 at one end and a connection portion 24 at the other end, and the second contacts 15 each including a first piece 19 having the contact portion 22 at one end and a pressure receiving portion 20 at the other end, a second piece 21 having a connection portion 24 at an outer end, and an elastic jointing-portion 31 for jointing the first piece 19 and the remaining end of the second piece 21, and a pivoting member 16 having an actuating portion 37, pushing portions 36, and anchoring holes 30, the pushing portions 36 being pivotally moved between the pressure receiving portions 20 and the connection portions 24 of the second contacts 15, during which pivotal movement, the axis 50 of rotation of the pushing portions 36 is moved with their pivotal movement to achieve their compact rotation, and further the second contacts 15 being each provided on the second piece 21 with a fixing portion 42 in the proximity of the elastic jointing-portion 31.

By the way, claim 1 of the Japanese Patent Application No. 2007-184,097 recites a connector including a required number of contacts each having a contact portion adapted to contact a connecting object, and a connection portion to be connected to a substrate, a housing having inserting holes for arranging and holding said contacts inserted in said inserting holes and a fitting opening into which said connecting object is inserted, and a pivoting member mounted on said housing on the opposite side of said fitting opening and causing said contacts to be elastically deformed so as to push said contacts against said connecting object, wherein said contacts consist of two kinds of first contacts and second contacts, and a first contact and a second contact are arranged in one and the same inserting hole of said housing so that the contact portions of the first and second contacts are facing to each other, wherein said first contacts each comprise the contact portion at one end and the connection portion at the other end, and said second contacts each comprise a first piece having the contact portion at one end and a pressure receiving portion at the other end, a second piece having the connection portion at an outer end, and an elastic jointing-portion for jointing said first piece and the remaining end of said second piece, wherein said pivoting member comprises an actuating portion for pivotally moving said pivoting member, pushing portions provided continuously in the longitudinal direction of the pivoting member, and anchoring holes independent from one another for receiving therein said pressure receiving portions, respectively, and said pushing portions are pivotally movable between said pressure receiving portions and said connection portions of said contacts, during which pivotal movement, the axis of rotation of said pushing portions is moved with their pivotal movement to achieve their compact rotation, and wherein said second contacts are each provided on said second piece with a fixing portion located in the proximity of said elastic jointing-portion, thereby preventing said second contacts from being warped when said pivoting member is being pivotally moved. Claim 2 recites the connector claimed in claim 1, wherein said connecting object is provided with anchoring portions on both sides in its width direction, and locking members each having engaging portion adapted to engage said anchoring portion are installed in said housing, and wherein said locking members each comprise a first piece having said engaging portion at one end and a pressure receiving portion at the other end, a second piece having a connection portion at an outer end, and an elastic jointing-portion for jointing said first piece and the remaining end of said second piece, and said locking members are each further provided on said second piece with a fixing portion located in the proximity of said elastic jointing-portion. Claim 3 recites the connector claimed in claim 1 or 2, wherein under a state that said connecting object is not inserted into said fitting opening of said housing, the contact portions of said second contacts are in said inserting holes without extending beyond the upper surface of said fitting opening into said fitting opening, and the contact portions of said first contacts extend beyond the lower surface of said fitting opening into said fitting opening so that the distance between tips of the contact portions of said first contacts and the upper surface of said fitting opening is smaller than the thickness of said connecting object, and wherein under a state that said connecting object has been inserted into said fitting opening of said housing and said pivoting member has been pivotally moved, said connecting object remains in contact with the contact portions of said first contacts without said connecting object being raised upwardly beyond the upper surface of the fitting opening of said housing even when said connecting object is accidentally subjected to an external force.

In recent years, with miniaturization of electric and electronic appliances, there have been an increasing demand for lighter and more compact connectors (miniaturization of connectors). In more detail, there have been increasing demands for lighter and more compact connector devices including a flexible printed circuit board (miniaturization of connector devices), and for more miniaturization of connector devices (high-density of conductors) and high-speed transmission of signals resulting from reduction in cross talk and the like.

However, there are conflicting problems for realizing the miniaturization of connectors (high density of conductors) and high speed transmission of signals. The realization of the high-speed transmission of signals involves matching of characteristic impedance and reduction in cross talk and skew. The realization of the miniaturization (high-density) involves employing narrow pitches. However, the matching of characteristic impedance and the reduction in cross talk make it difficult to realize the narrow pitches (less than 0.4 mm). In order to realize the narrow pitch less than 0.3 mm, it is envisioned to arrange the contacts to be staggered. However, such a staggered arrangement of contacts makes it impossible to reduce the skew.

With the construction of connectors disclosed in the Patent Literature 1, 3 and 4, although the lighter or more compact connectors can be realized, it would be difficult to realize due to higher-density of conductors and high-speed transmission of signals may comes to a problem of reduction in cross talk and the like. On the other hand, with the connector disclosed in the Patent Literature 2, although the lighter or more compact and high-density connector can be realized, it would be impossible to realize the high-speed transmission of signals resulting from the problem of reduction in cross talk and the like.

As in the Patent Literature 5, if the flexible printed circuit board is provided with contact portions on its front and rear surfaces, 0.2 mm of signal pitch can be obtained with a pitch of 0.4 mm on each of both surfaces without arranging the contacts to be staggered. However, the high-speed transmission of signals could not be achieved due to the problem of matching of characteristic impedance on both the surfaces and the reduction of cross talk. Even with an intermediate ground layer provided, an increase in ground pass due to through-hole connection would be likely to occur.

With the rear locking type connectors (the pivoting member is pivotally moved on the opposite side of the fitting opening to cause the contacts to be pushed to the connecting object) as disclosed in the Patent Literatures 1 to 4, further, after a connecting object such as a flexible printed circuit board or flexible flat cable has been inserted into the fitting opening of the housing, when the pushing portions of the pivoting member are pivotally moved between the connection portions and the pressure receiving portions of the contacts, the pressure receiving portions are raised (pushed upward) by the pushing portions to cause the elastic portions of the contacts to be tilted about the fulcrum portions toward the contact portions so that the contact portions are pushed to the connecting object such as the flexible printed circuit board or flexible flat cable, thereby achieving the contact between the contact portions of the contacts and the connecting object. With such a construction disclosed in the Patent Literatures 1 to 4, however, when the pressure receiving portions of the contacts are pushed by the pushing portions of the pivoting member, the pressure receiving portions are moved upward (toward the above viewed in FIG. 14A) to cause the contact portions of the contacts to be pushed to the connecting object such as the flexible printed circuit board or flexible flat cable as described above. At that time, with the constructions disclosed in the Patent Literatures 1 to 4, the contact portions are raised (toward the above viewed in FIG. 14A) about the fixed portions of the contacts as fulcrum portions by the reaction forces arising from the connecting object such as flexible printed circuit board or flexible flat cable, and the elastic portions are also raised by the reaction forces. In this way, the intended function described above would be impeded, resulting in an unstable connection between the contacts and the connecting object. This problem has remained to be solved.

With the connector using the two kinds of contacts arranged above and below to embrace the connecting object by pushing the contact portions of the contacts in the above position as disclosed in the Patent Literature 2, if the contact portions positioned in the above are caused to be raised, the force for pushing the contact portions against the connecting object becomes weak to make it difficult to embrace the connecting object, resulting in a more unstable connection between the contacts and the connecting object.

Even with the locking members similar in construction to the contacts as disclosed in the Patent Literatures 3 and 4, there would be a possibility of causing the engaging portions adapted to engage the connecting object to be raised so that the holding force for the connecting object would be lowered.

FIG. 16 illustrates S-parameters of combinations of hitherto used flexible printed circuit board and connector. Referring to FIG. 16 illustrating curves of Sdd 11 to Sdd 41 representing values of signal attenuation, the attenuation value of Sdd 21 is less than −3 dB at the frequency of 1.5 GHz in a transmission rate of 3 Gbps, and the value of Sdd 31 is more than −40 dB. While the value of Sdd 41 is also −40 dB, and the value of Sdd 11 of return loss is more than −15 dB over the entire zone. In a graph shown in FIG. 17, moreover, results of eye patterns at 3 Gbps are also clearly shown. From these results, the hitherto used devices would be able to transmit signals of 3 Gbps.

SUMMARY OF THE INVENTION

In view of the problems of the prior art described above, the invention has been completed and the invention has an object to provide a connector device (consisting of a connector to be used with a flexible printed circuit board provided with a ground layer between its front and rear surfaces) enabling respective contacts to come into contact with contact portions of the flexible printed circuit board and at the same time enabling members to contact the ground layer intermediate between the front and rear surfaces of the flexible printed circuit board, thereby achieving a miniaturization (high-density i.e., 0.2 mm contact pitch) of the connector and simultaneously high-speed transmission of signals over 3 Gbps.

The object of the invention described above can be achieved by the connector device 1 including a connector 10 to be used with a flexible printed circuit board 80 formed with a required number of patterns on its front and rear surfaces, and said connector 10 including a required number of contacts each having a contact portion 22 adapted to contact said flexible printed circuit board 80 and a connection portion 24 to be connected to a substrate, a housing 12 having inserting holes 38 for arranging and holding said contacts inserted therein and a fitting opening 18 into which said flexible printed circuit board is inserted, and a pivoting member 16 mounted on said housing 12 on the side or opposite side of said fitting opening 18 for elastically deforming said contacts to push them to said flexible printed circuit board 80 or an inserting member which is inserted into said fitting opening 18 for elastically deforming said contacts to push them to said flexible printed circuit board 80, wherein said flexible printed circuit board 80 is provided with required numbers of ground patterns 83, signal patterns 84 and phase inversion signal patterns 85 whose phases are inverted, and with a ground layer 86 arranged between said front and rear surfaces, said signal pattern 84 and said phase inversion signal pattern 85 being arranged between said ground patterns 83, and said flexible printed circuit board is provided at predetermined positions with exposed portions 87 which reach said ground layer 86 at least from the side of its one surface, wherein said contacts of said connector consist of first contacts 14 and second contacts 15 of two kinds, and one first contact 14 and one second contact 15 are arranged in one and the same inserting hole 38 of said housing 12 such that the contact portions 22 of the first contact 14 and the second contact 15 are opposite to each other, and wherein when said pivoting member 16 is pivotally moved or said inserting member is inserted into said connector, said first contacts 14 and said second contacts 15 corresponding to the respective patterns 83, 84 and 85 come into contact with said flexible printed circuit board, and ground members 17 or locking and ground members 17 located at predetermined positions enter said exposed portions 87 so as to contact said ground layer 86.

The connector device 1 is so constructed that said first contacts 14 each comprise at one end the contact portion 22 and at the other end the connection portion 24, that said second contacts 15 each comprise a first piece 19 having at one end the contact portion 22 and at the other end a pressure receiving portion 20, a second piece 21 having at one end the connection portion 24, an elastic jointing-portion 31 (consisting of a fulcrum portion 32 and an elastic portion 34) for jointing said first piece 19 and the remaining end of said second piece 21, and a fixing portion 42 for fixing said second contact 15 to said housing 12, and that said pivoting member 16 comprises an actuating portion 37 for pivotally moving said pivoting member, pushing portions 36 provided continuously in the longitudinal direction of the pivoting member, and anchoring holes 30 independent from one another for receiving therein said pressure receiving portions 20, respectively, and said pushing portions 36 are pivotally movable between said pressure receiving portions 20 and said connection portions 24 of said contacts 15.

The connector device 1 is so constructed that said second contacts are each comprise a first piece 19 having at one end the contact portion 22, and an extension piece 62 extending in parallel with said first piece 19 so that said pushing portions 36 of said pivoting member 16 are pivotally movable between said first pieces 19 and said extension pieces 62.

The connector device 1 is so constructed that said inserting member is constructed to be inserted between second contacts and said housing.

The connector device 1 is so constructed that said ground members 17 are each constructed substantially in the same construction as that of said second contacts 15.

The connector device 1 is so constructed that said ground members 17 each comprise a first piece 191 having at one end a contact portion 22 and at the other end a pressure receiving portion 201, a second piece 211 having at one end a contact portion 22 and at the other end a connection portion 241, an elastic jointing-portion 311 (consisting of a fulcrum portion 321 and an elastic portion 341) for jointing said first piece 191 and said second piece 211, and a fixing portion 421 for fixing said member to said housing 12.

The connector device 1 is so constructed that said ground members 17 each consist of a first member and a second member having substantially the same constructions as those of said first contact 14 and said second contact 15, respectively, so that either, or both, of the first and second members are brought into contact with said ground layer 86.

The connector device 1 is so constructed that said ground members 17 each comprise a first piece 191 having at one end a contact portion 22 and at the other end a pressure receiving portion 201, a second piece 211 having at one end a connection portion 241, an elastic jointing-portion 311 (consisting of a fulcrum portion 321 and an elastic portion 341) for jointing said first piece 191 and the remaining end of said second piece 211, and a fixing portion 421 for fixing said member to said housing 12.

The connector device 1, is so constructed that said ground members 17 are formed as a shell 172 covering said housing 12, said shell 172 being provided at predetermined positions with extended pieces 60 which enter said exposed portions 87 of said flexible printed circuit board 80 and come into contact with said ground layer 86.

The connector device 1 is so constructed that when said pushing portions 36 of said pivoting member 16 are pivotally moved between said pressure receiving portions 20 and connection portions 24 of said contacts 15 and said ground members 17 or between said pressure receiving portions 20 and said housing 12, rotational axes 50 of said pushing portions 36 progressively move so that the pushing portions 36 perform their compact rotations, and that the fixing portions 42 of said second contacts 15 and said ground members 17 are each provided on said second piece 21 in the proximity of said elastic jointing-portion 31 (consisting of a fulcrum portion 32 and an elastic portion 34), thereby preventing said second contacts 15 and said ground members 17 from being warped when said pivoting member 16 is being pivotally moved.

The connector device 1 is so constructed that said flexible printed circuit board 80 is provided with anchoring portions 82 on both sides in its width direction, and locking members 171 each having an engaging portion 56 adapted to engage said anchoring portion 82 are installed in said housing 12, said locking members 171 each comprising a first piece 191 having at one end the engaging portion 56 and at the other end a pressure receiving portion 20, a second piece 211 having at one end a connection portion 241, and an elastic jointing-portion 311 (consisting of a fulcrum portion 321 and an elastic portion 341) for jointing said first piece 191 and the remaining end of said second piece 211.

The connector device 1 is so constructed that said flexible printed circuit board 80 is provided on both sides in its width direction with anchoring portions 82 which are used as said exposed portions 87, and said locking members 171 are used as said ground members 17, and that said engaging portions 56 of said locking members 171 are brought into engagement with the anchoring portions 82 of said flexible printed circuit board 80 to cause said locking members 171 to contact said ground layer 86.

The connector device 1 is so constructed that under a state that said flexible printed circuit board 80 is not inserted into said connector 10, the contact portions 22 of said second contacts 15 are in said inserting holes 38 without extending into said fitting opening 18 beyond the upper surface 57 of said fitting opening 18, and the contact portions 22 of said first contacts 14 extend into said fitting opening 18 beyond the lower surface 58 of said fitting opening so that the distance between tips of the contact portions 22 of said first contacts 14 and the upper surface 57 of said fitting opening 18 is smaller than the thickness of said flexible printed circuit board 80, and that under a state that said flexible printed circuit board 80 has been inserted into said fitting opening 18 and said pivoting member 16 has been pivotally moved, said flexible printed circuit board 80 remains in contact with the contact portions 22 of said first contacts 14 without said flexible printed circuit 80 being raised upwardly beyond the upper surface 57 of the fitting opening of said housing 12 even when said flexible printed circuit board 80 is accidentally subjected to an external force.

As can be seen from the above description, the connector device according to the invention can bring about the following functions and effects. (1) In the connector device 1 mating with a flexible printed circuit board 80 formed with a required number of patterns on its front and rear surfaces, and having a connector 10 including a required number of contacts each having a contact portion 22 adapted to contact said flexible printed circuit board 80 and a connection portion 24 to be connected to a substrate, a housing 12 having inserting holes 38 for arranging and holding said contacts inserted therein and a fitting opening 18 into which said flexible printed circuit board is inserted, and a pivoting member 16 mounted on said housing 12 on the side or opposite side of said fitting opening 18 for elastically deforming said contacts to push them to said flexible printed circuit board 80 or an inserting member which is inserted into said fitting opening 18 for elastically deforming said contacts to push them to said flexible printed circuit board 80, according to the invention the connector device is so constructed that said flexible printed circuit board 80 is provided with required numbers of ground patterns 83, signal patterns 84 and phase inversion signal patterns 85 whose phases are inverted, and with a ground layer 86 arranged between said front and rear surfaces, said signal pattern 84 and said phase inversion signal pattern 85 being arranged between said ground patterns 83, and said flexible printed circuit board is provided at predetermined positions with exposed portions 87 which reach said ground layer 86 at least from the side of its one surface, that said contacts of said connector consist of first contacts 14 and second contacts 15 of two kinds, and one first contact 14 and one second contact 15 are arranged in one and the same inserting hole 38 of said housing 12 such that the contact portions 22 of the first contact 14 and the second contact 15 are opposite to each other, and that when said pivoting member 16 is pivotally moved or said inserting member is inserted into said connector, said first contacts 14 and said second contacts 15 corresponding to the respective patterns 83, 84 and 85 come into contact with said flexible printed circuit board, and ground members 17 located at predetermined positions enter said exposed portions 87 so as to contact said ground layer 86. Therefore, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector. The predetermined positions are referred to herein as "positions within a size of the housing 12 mounted with the ground members 17 (positions in an area occupied by the connector 10)".

(2) The connector device 1 is so constructed that said first contacts 14 each comprise at one end the contact portion 22 and at the other end the connection portion 24, that said second contacts 15 each comprise a first piece 19 having at one end the contact portion 22 and at the other end a pressure receiving portion 20, a second piece 21 having at one end the connection portion 24, an elastic jointing-portion 31 (consisting of a fulcrum portion 32 and an elastic portion 34) for jointing said first piece 19 and the remaining end of said second piece 21, and a fixing portion 42 for fixing said second contact 15 to said housing 12, and that said pivoting member 16 comprises an actuating portion 37 for pivotally moving said pivoting member, pushing portions 36 provided continuously in the longitudinal direction of the pivoting member, and anchoring holes 30 independent from one another for receiving therein said pressure receiving portions 20, respectively, and said pushing portions 36 are pivotally movable between said pressure receiving portions 20 and said connection portions 24 of said contacts 15. Accordingly, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(3) The connector device 1 is so constructed that said second contacts each comprise a first piece 19 having at one end the contact portion 22, and an extension piece 62 extending in parallel with said first piece 19 so that said pushing portions 36 of said pivoting member 16 are pivotally movable between said first pieces 19 and said extension pieces 62. Consequently, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(4) The connector device 1 is so constructed that said inserting member is constructed to be inserted between second contacts and said housing. Therefore, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(5) The connector device 1 is so constructed that said ground members 17 are each constructed substantially in the same construction as that of said second contacts 15. Therefore, the connector device according to the invention not only achieves a miniaturization of a connector, but also realizes a high-density on the order of a pitch of 0.2 mm with a simple construction. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(6) The connector device 1 is so constructed that said ground members 17 each comprise a first piece 191 having at one end a contact portion 22 and at the other end a pressure receiving portion 201, a second piece 211 having at one end a contact portion 22 and at the other end a connection portion 241, an elastic jointing-portion 311 (consisting of a fulcrum portion 321 and an elastic portion 341) for jointing said first piece 191 and said second piece 211, and a fixing portion 421 for fixing said member to said housing 12. Therefore, the connector device according to the invention not only achieves a miniaturization of a connector, but also realizes a high-density on the order of a pitch of 0.2 mm with a simple construction. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(7) The connector device 1 is so constructed that said ground members 17 each consist of a first member and a second member having substantially the same constructions as those of said first contact 14 and said second contact 15, respectively, so that either, or both, of the first and second members are brought into contact with said ground layer 86. Consequently, the connector device according to the invention securely enables said ground members 17 to be in contact with said ground layer 86 with a simple construction and not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(8) The connector device 1 is so constructed that said ground members 17 each comprise a first piece 191 having at one end a contact portion 22 and at the other end a pressure receiving portion 201, a second piece 211 having at one end a connection portion 241, an elastic jointing-portion 311 (consisting of a fulcrum portion 321 and an elastic portion 341) for jointing said first piece 191 and the remaining end of said second piece 211, and a fixing portion 421 for fixing said member to said housing 12. Therefore, the connector device according to the invention securely enables said ground members 17 to be in contact with said ground layer 86 with a simple construction and not only achieves a miniaturization of a connector, but also realizes a high-density on the order of a pitch of 0.2 mm. According to the invention high speed transmission of signals can be accomplished by enabling easy matching of characteristic impedance, and reduction in cross talk and skew, and at the same time the decrease in ground pass can be achieved to provide a miniaturized (narrower pitches), high-frequency, high-speed and high-density connector.

(9) The connector device 1 is so constructed that said ground members 17 are formed as a shell 172 covering said housing 12, said shell 172 being provided at predetermined positions with extended pieces 60 which enter said exposed portions 87 of said flexible printed circuit board 80 and come into contact with said ground layer 86. Therefore, the connector device according to the invention securely enables said ground members 17 to be in contact with said ground layer 86 with a simple construction and not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(10) The connector device 1 is so constructed that when said pushing portions 36 of said pivoting member 16 are pivotally moved between said pressure receiving portions 20 and connection portions 24 of said contacts 15 and said ground members 17 or between said pressure receiving portions 20 and said housing 12, rotational axes 50 of said pushing portions 36 progressively move so that the pushing portions 36 perform their compact rotations, and that the fixing portions 42 of said second contacts 15 and said ground members 17 are each provided on said second piece 21 in the proximity of said elastic jointing-portion 31 (consisting of a fulcrum portion 32 and an elastic portion 34), thereby preventing said second contacts 15 and said ground members 17 from being warped when said pivoting member 16 is being pivotally moved. Consequently, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(11) The connector device 1 is so constructed that said flexible printed circuit board 80 is provided with anchoring portions 82 on both sides in its width direction, and locking members 171 each having an engaging portion 56 adapted to engage said anchoring portion 82 are installed in said housing 12, said locking members 171 each comprising a first piece 191 having at one end the engaging portion 56 and at the other end a pressure receiving portion 20, a second piece 211 having at one end a connection portion 241, and an elastic jointing-portion 311 (consisting of a fulcrum portion 321 and an elastic portion 341) for jointing said first piece 191 and the remaining end of said second piece 211. Therefore, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(12) The connector device 1 is so constructed that said flexible printed circuit board 80 is provided on both sides in its width direction with anchoring portions 82 which are used as said exposed portions 87, and said locking members 171 are used as said ground members 17, and that said engaging portions 56 of said locking members 171 are brought into engagement with the anchoring portions 82 of said flexible printed circuit board 80 to cause said locking members 171 to contact said ground layer 86. Accordingly, the connector device according to the invention not only achieves a miniaturization of a connector, but also realizes a high-density on the order of a pitch of 0.2 mm by merely utilizing the parts for increasing the folding force for the flexible printed circuit board. According to the invention high speed transmission of signals can be accomplished by enabling easy matching of characteristic impedance and reduction in cross talk and skew, and at the same time the decrease in ground pass can be achieved to provide a miniaturized (narrower pitches), high-frequency, high-speed and high-density connector.

(13) The connector device is so constructed that under a state that said flexible printed circuit board 80 is not inserted into said connector 10, the contact portions 22 of said second contacts 15 are in said inserting holes 38 without extending into said fitting opening 18 beyond the upper surface 57 of said fitting opening 18, and the contact portions 22 of said first contacts 14 extend into said fitting opening 18 beyond the lower surface 58 of said fitting opening so that the distance between tips of the contact portions 22 of said first contacts 14 and the upper surface 57 of said fitting opening 18 is smaller than the thickness of said flexible printed circuit board 80, and that under a state that said flexible printed circuit board 80 has been inserted into said fitting opening 18 and said pivoting member 16 has been pivotally moved, said flexible printed circuit board 80 remains in contact with the contact portions 22 of said first contacts 14 without said flexible printed circuit 80 being raised upwardly beyond the upper surface 57 of the fitting opening of said housing 12 even when said flexible printed circuit board 80 is accidentally subjected to an external force. Therefore, the connector device according to the invention not only achieves a miniaturization of a connector, but also realizes a high-density on the order of a pitch of 0.2 mm. According to the invention high speed transmission of signals can be accomplished by enabling easy matching of characteristic impedance and reduction in cross talk and skew, and at the same time the decrease in ground pass length can be achieved to provide a further miniaturized (narrower pitches), high-frequency, high-speed and high-density connector.

The connector device 1 according to the invention to be used with the flexible printed circuit board 80 using its both the surfaces and hence the connector also constructed correspondingly to the flexible printed circuit board using both the surfaces. If considering only one surface, the connector device may be similar to the conventional one and also similar in transmission performance to the conventional one. Since the ground layer 86 is provided in the flexible printed circuit board between its front and rear surfaces, however, it becomes possible to prevent the electromagnetic interference between the front and rear surfaces so that twofold transmission lines can be ensured in comparison with the prior art. Moreover, if a transmission system for transmitting one signal with two sets of differential transmission lines is employed, a transmission of 6 Gbps is possible.

The invention will be more fully understood by referring to the following detailed specification and claims taken in connection with the appended drawings.

DESCRIPTION OF THE PREFERRED EMBODIMENTS

Figure 1A:
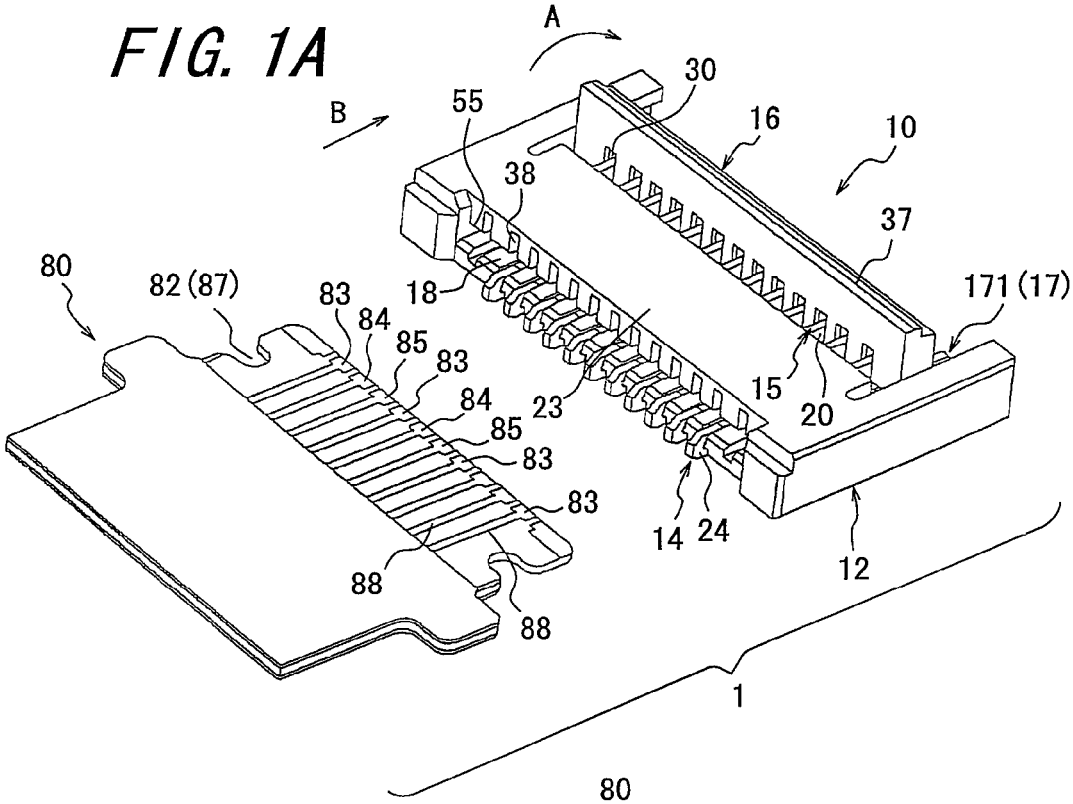
FIG. 1A is a perspective view of a connector device according to the invention viewed from the above on the side of the fitting opening.

The important aspect of the invention lies in that a flexible printed circuit board 80 is provided with required numbers of ground patterns 83, signal patterns 84 and phase inversion signal patterns 85 whose phases are inverted, and with a ground layer 86 between said front and rear surfaces, the signal pattern 84 and the phase inversion signal pattern 85 being arranged between the ground patterns 83, and the flexible printed circuit board 80 is provided at predetermined positions with exposed portions 87 (recessed portions 871) which reach said ground layer 86, that the contacts of the connector 10 consist of first contacts 14 and second contacts 15 of two kinds, and one first contact 14 and one second contact 15 are arranged in one and the same inserting hole 38 such that the contact portions 22 of the first contact 14 and the second contact 15 are opposite to each other for using these contacts as an upper and lower contact structure. The connector 10 further includes a pivoting member 16 mounted on the housing 12 on the side or opposite side of said fitting opening 18 for elastically deforming said contacts to push them to said flexible printed circuit board 80 or an inserting member which is inserted into the fitting opening 18 for elastically deforming the contacts to push them to the flexible printed circuit board, and when the pivoting member 16 is pivotally moved or the inserting member is inserted into the connector, the first contacts 14 and the second contacts 15 corresponding to the respective patterns 83, 84 and 85 come into contact with the flexible printed circuit board, and ground members 17 (locking members 171) located at predetermined positions enter the recesses 87 so as to contact the ground layer 86.

In other words, the high density of the order of 0.2 mm the contact pitch of the connector device can be achieved by bringing the two kinds of the contacts (first and second contacts 14 and 15) inserted into the same inserting holes 38, respectively, into contact with the patterns (the signal pattern 84 and the phase inversion signal pattern 85 are arranged between the two ground patterns 83) arranged on the front and rear surfaces of the flexible printed circuit board 80. Moreover, the high speed transmission of signals and reduction in ground pass can be accomplished by the ease of matching of characteristic impedance, reduction in cross talk and skew, and further simultaneously a miniaturization (narrower pitches) of the connector device and high frequency, high speed and high-density connector device can be provided by arranging the signal pattern 84 and the phase inversion signal pattern 85 between the two ground patterns 83, by providing the ground layer 86 between the front and rear surfaces of the flexible printed circuit board 80 provided at predetermined positions with the exposed portions 87 (recessed portions 871) which reach the ground layer 86, and by causing the ground members 17 (171) to contact the ground layer 86.

One embodiment of the connector device 1 according to the invention will be explained with reference to FIGS. 1A to 9E.

Figure 1B:
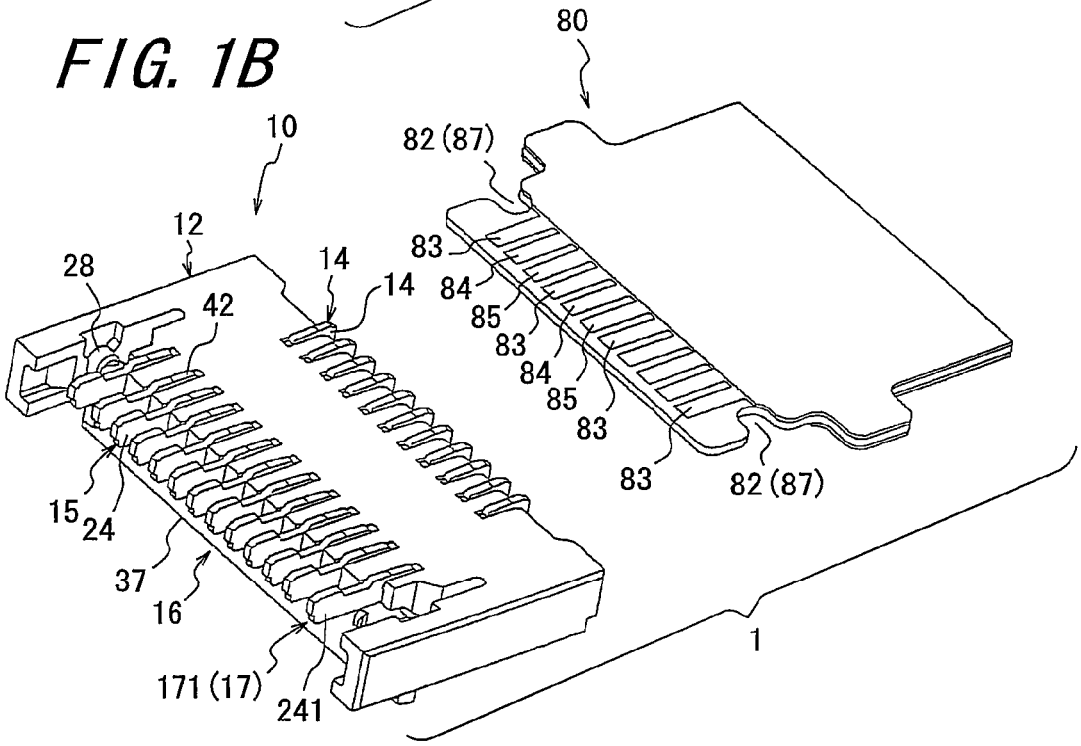
FIG. 1B is a perspective view of the connector device shown in FIG. 1A viewed from the below on the opposite side of the fitting opening.
Figure 2A:
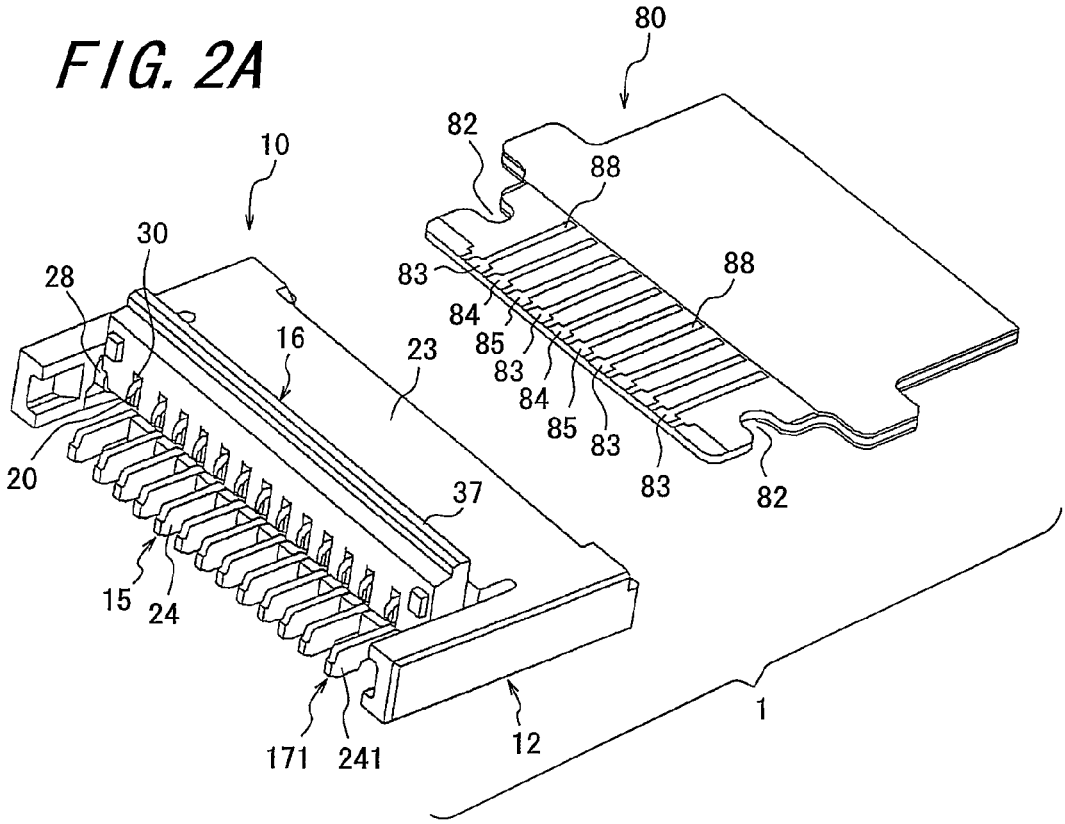
FIG. 2A is a perspective view of the connector device according to the invention viewed from the above on the opposite side of the fitting opening.
Figure 2B:
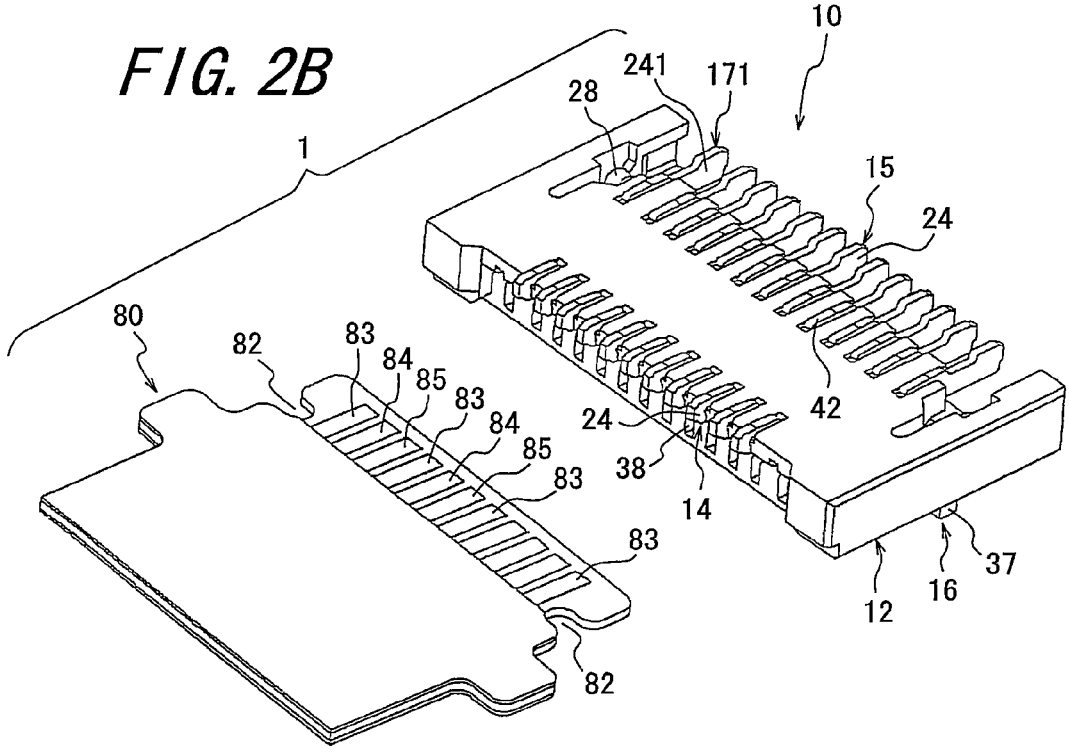
FIG. 2B is a perspective view of the connector device shown in FIG. 2A viewed from the below on the side of the fitting opening.
Figure 3A:
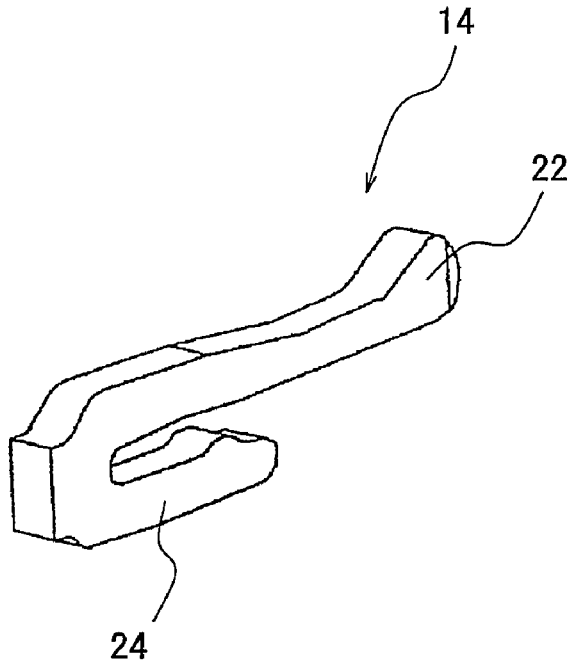
FIG. 3A is a perspective view of a first contact.
Figure 3B:
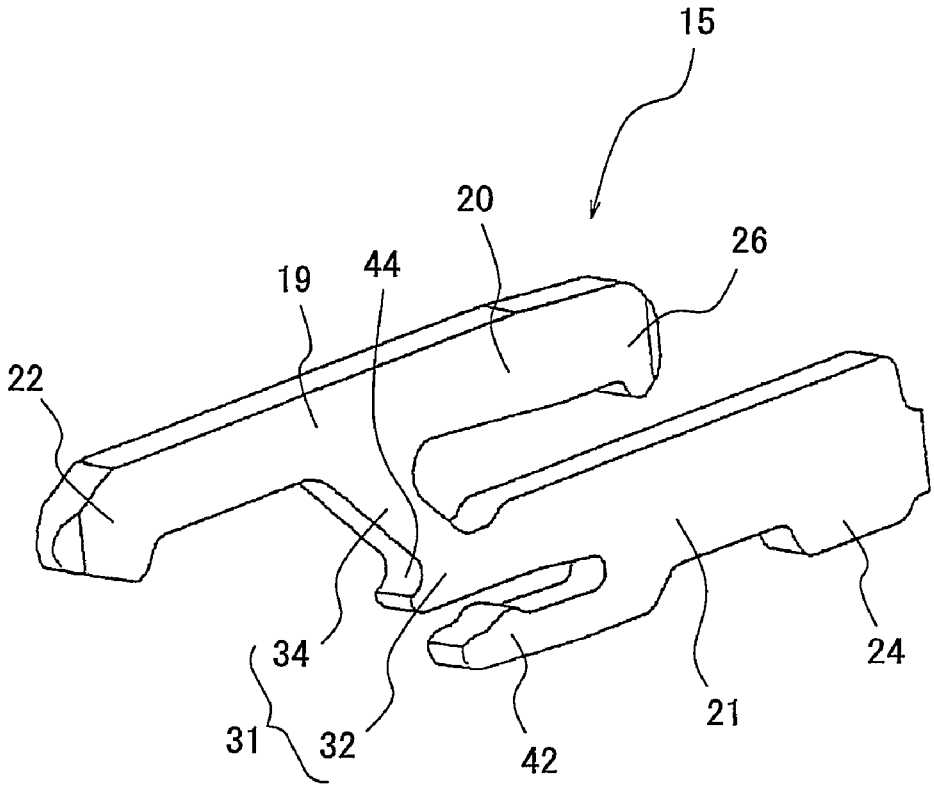
FIG. 3B is a perspective view of a second contact.
Figure 4:
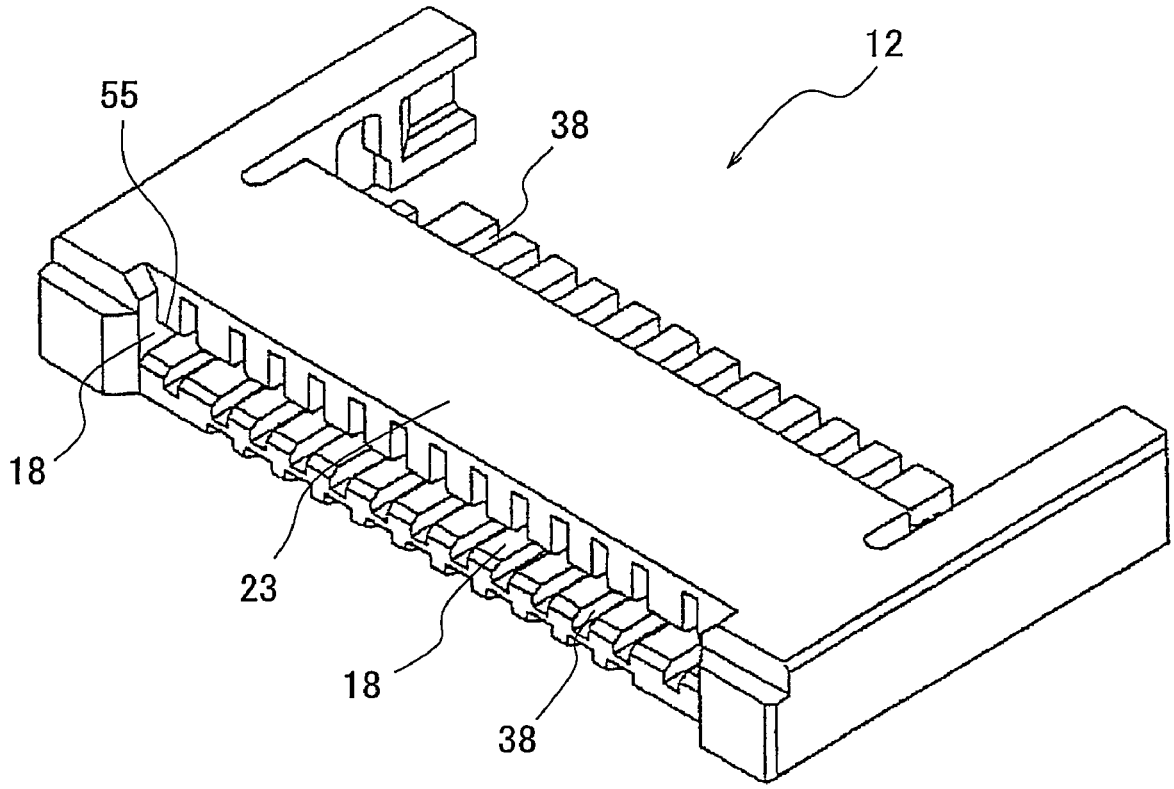
FIG. 4 is a perspective view of a housing.
Figure 5:
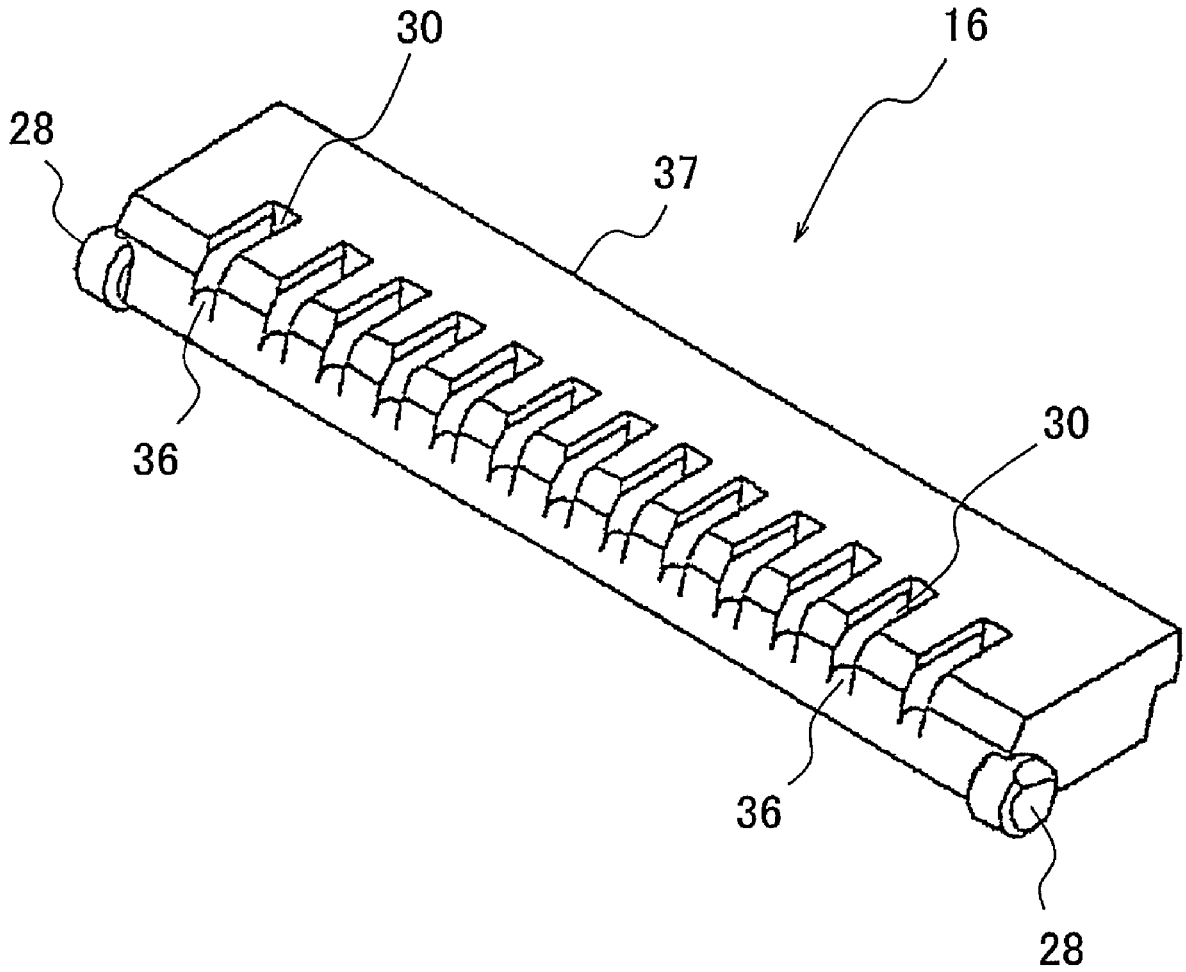
FIG. 5 is a perspective view of a pivoting member.
Figure 6:
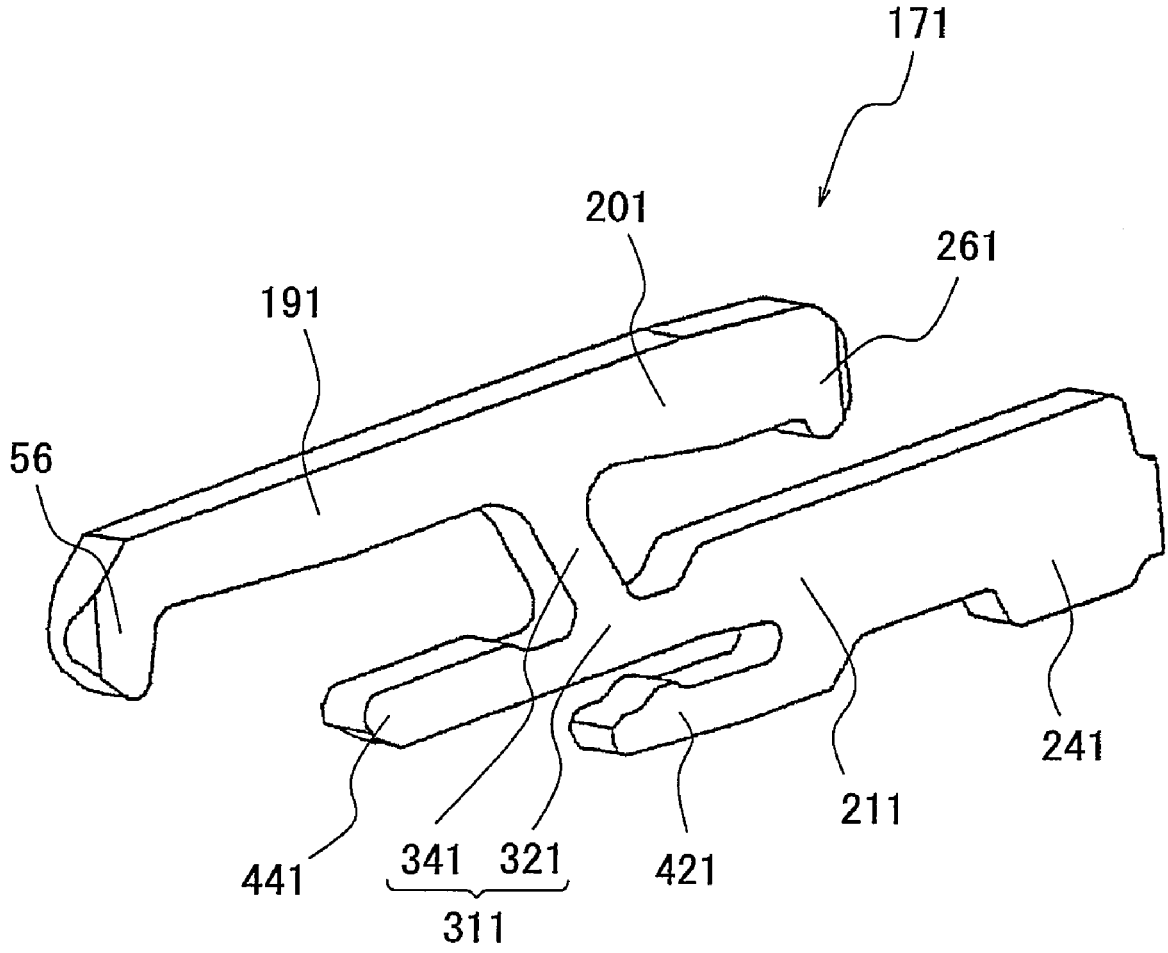
FIG. 6 is a perspective view of a locking member.
Figure 7A:
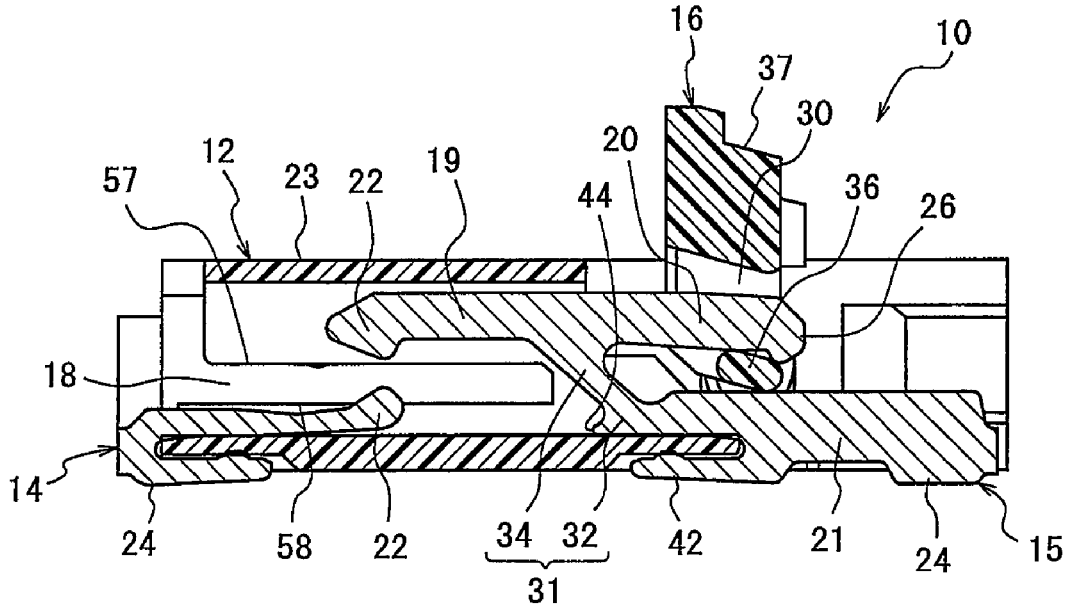
FIG. 7A is a sectional view of the connector with the pivoting member opened, taken along one inserting hole for contacts.
Figure 7B:
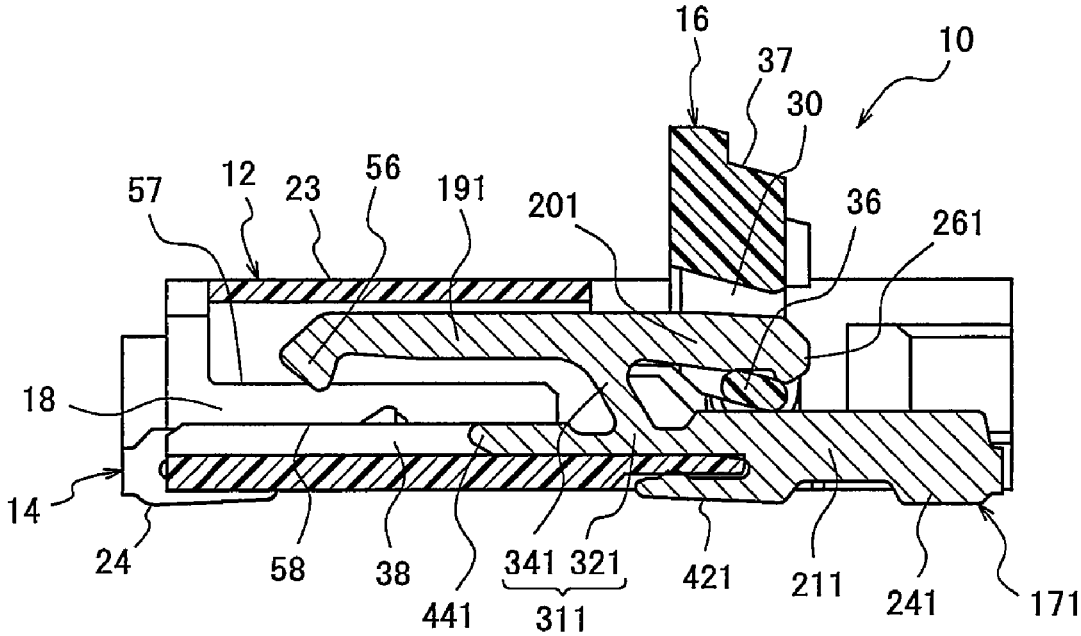
FIG. 7B is a sectional view of the connector with the pivoting member opened, taken along one inserting hole for the locking member.
Figure 8A:
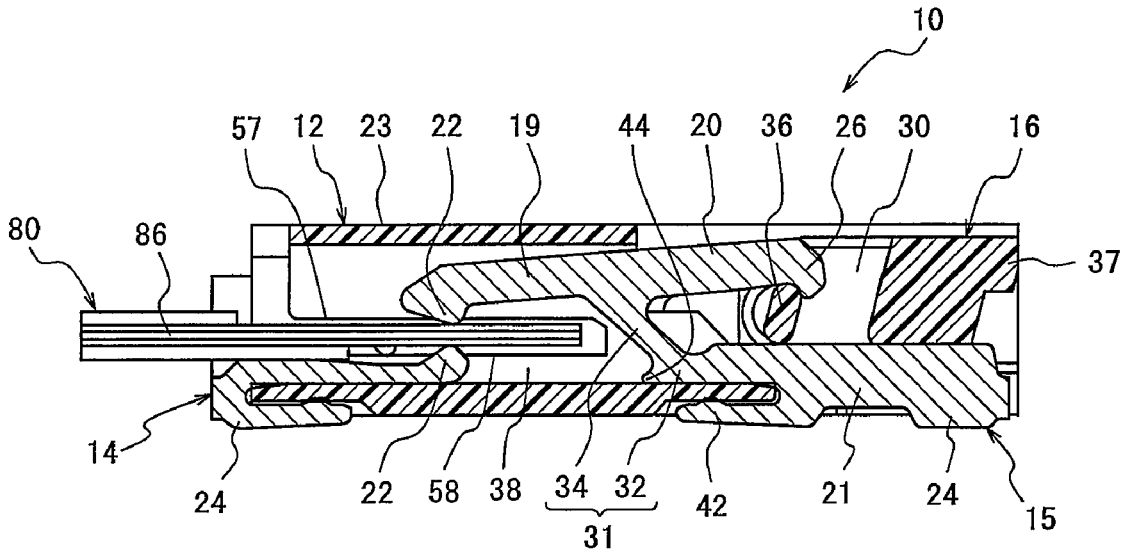
FIG. 8A is a sectional view of the connector with the pivoting member closed and with the flexible printed circuit board inserted, taken along one inserting hole for the contacts.
Figure 8B:
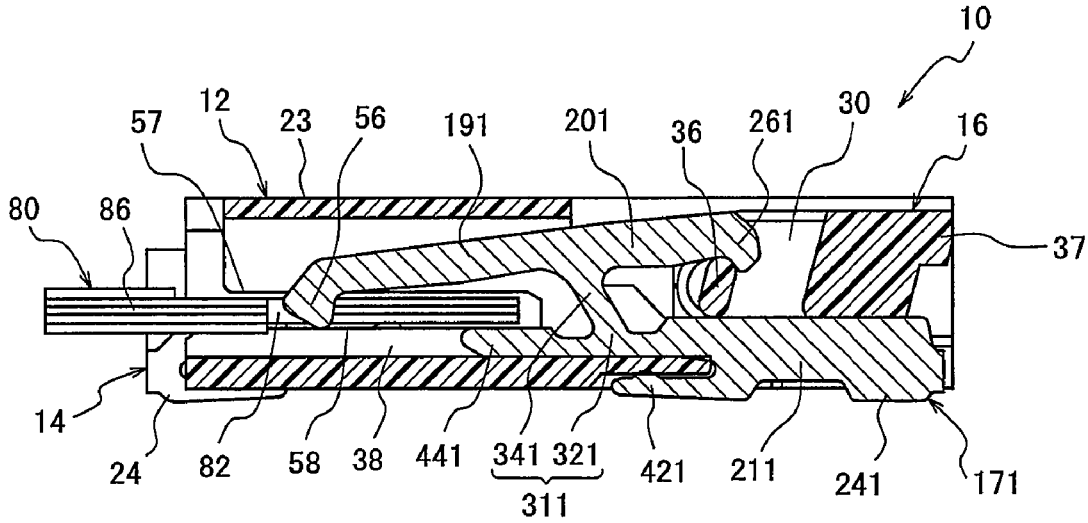
FIG. 8B is a sectional view of the connector with the pivoting member closed and with the flexible printed circuit board inserted, taken along one inserting hole for the locking member.

FIG. 1A is a perspective view of the connector device according to the invention comprising a connector used for a flexible printed circuit board viewed from the above on the side of the fitting opening, and FIG. 1B is a perspective view of the connector and the flexible printed circuit board shown in FIG. 1A viewed from the below on the opposite side of the fitting opening. FIG. 2A is a perspective view of the connector device according to the invention comprising the connector and the flexible printed circuit board viewed from the above on the opposite side of the fitting opening, while FIG. 2B is a perspective view of the connector device comprising the connector and the flexible printed circuit board shown in FIG. 2A viewed from the below on the side of the fitting opening. FIG. 3A is a perspective view of a first contact, while FIG. 3B is a perspective view of a second contact. FIG. 4 is a perspective view of a housing, while FIG. 5 is a perspective view of a pivoting member and FIG. 6 is a perspective view of a locking member. FIG. 7A is a sectional view of the connector with the pivoting member opened, taken along one inserting hole for the contacts, and FIG. 7B is a sectional view of the connector with the pivoting member opened, taken along one inserting hole for the locking member. FIG. 8A is a sectional view of the connector with the pivoting member closed and with the flexible printed circuit board inserted, taken along one inserting hole for the contacts, while FIG. 8B is a sectional view of the connector with the pivoting member closed and with the flexible printed circuit board inserted, taken along one inserting hole for a locking member. FIGS. 9A to 9E are explanatory views for explaining movements of a pushing portion and an axis of rotation when the pivoting member is being pivotally moved.

The connector device 1 according to the invention to be used with a flexible printed circuit board 80, comprises a connector 10 mainly having a housing 12, first contacts 14, second contacts 15, a pivoting member 16, and ground members 17 (171).

First, the flexible printed circuit board 80 will be explained. The flexible printed circuit board 80 comprises at least patterns adapted to be in contact with contact portions 22 of the contacts 14 and 15 of two kinds, conductors 88 connected from the patterns to circuits, a ground layer 86 arranged between a front and a rear surface, recessed portions 87 at predetermined positions extending to the ground layer 86. In the illustrated embodiment, the patterns of the flexible printed circuit board 80 are arranged on both the front and rear surfaces in a manner such that a signal pattern 84 and a phase inversion signal pattern 85 are arranged between the ground patterns 83. In the illustrated embodiment, moreover, as said recessed portions, there are provided anchoring portions 82 adapted to engage locking members 171, respectively. Using said flexible printed circuit board 80 thus constructed, a stable connection state can be held even under vibrations, and also a flexibility can be maintained.

The shape of said anchoring portions 82 may be any one insofar as they can engage engaging portions 56 of the locking members 171 and the engaging portions 56 come into contact with said ground layer 86. In the illustrated embodiment, the anchoring portions 82 are U-shaped notches. They may be through-holes or blind holes according to a specification.

Positions of said recessed portions 87 may be arbitrary so long as the recessed portions 87 are inside the size of said housing 12 (within the area occupied by the connector 10) provided with the locking members 171 or the ground members 17 of the same construction as that of the second contacts 15 and do not contact the contacts 14 and 15 and do not interfere with the pivotal movement of the pivoting member 16.

Components of the connector 10 according to the invention will be explained with reference to the drawings. First, the contacts will be explained. Both the first and second contacts 14 and 15 of the two kinds are made of a metal and formed by means of the press-working of the known technique. Preferred metals from which to form said contacts of the two kinds include brass, beryllium copper, phosphor bronze and the like which comply with the requirements as to springiness, electric conductivity and the like. In the illustrated embodiment, two contacts of the two kinds (first contact 14 and second contact 15) are into one and the same inserting hole 38 of the housing 12 in a manner such that the first contact 14 is inserted into the inserting hole from the side of the fitting opening 18 and the second contact 15 is inserted into the inserting hole from the opposite side of the fitting opening 18 to form an upper and lower contact structure.

Said first contact 14 is substantially i-shaped and comprises a contact portion 22 at one end and a connection portion 24 at the other end. The contact portion 22 is of a protruded shape for facilitating the contact with a flexible printed circuit board 80. Although the connection portion 24 is of a surface mounting type (SMT) as shown in FIG. 3A, it may be a dip type. The contact portion 22 of the first contact 14 is arranged so as to be opposite (facing) to a contact portion 22 of the second contact 15.

The second contact 15 comprises at least a first piece 19 having a contact portion 22 at one end and a pressure receiving portion 20 at the other end, a second piece 21 having a connection portion 24 at its outer end, and an elastic jointing-portion 31 (consisting of a fulcrum portion 32 and an elastic portion 34) for jointing or connecting said first piece 19 and the remaining end of said second piece 21. The elastic jointing-portion 31 includes the fulcrum portion 32 and the elastic potion 34 in the illustrated embodiment. In other words, the second contact 15 is substantially inverted h-shaped as shown in FIG. 3B, and comprises the first piece 19 having at the one end the contact portion 22 adapted to contact the flexible printed circuit board 80, at the other end the pressure receiving portion 20 to be pushed by the pivoting member 16, and an extended portion 26 inwardly extending from the tip of the pressure receiving portion 20, the second piece 21 having at one end the fulcrum portion 32 and at the other end the connection portion 24 to be connected to a substrate, the elastic portion 34 for jointing or connecting the substantially center of said first piece 19 and said fulcrum portion 32 of said second piece 21 (the elastic jointing-portion 31 consisting of said fulcrum portion 32 and said elastic portion 34), and a fixing portion 42 provided on said second piece 21 in the proximity of the elastic jointing-portion 31 of said second contact 15 and close to the main body of said second piece 21. Said contact portion 22 of said first piece 19, said elastic portion 34, said fulcrum portion 32, and said connection portion 24 are arranged substantially in the form of a crank.

Said fixing portion 42 is provided on said second piece 21 in the proximity of the elastic jointing-portion 31 of said second contact 15 and close to the main body of the second piece 21. In other words, the fixing portion 42 is located below the proximity of the fulcrum portion 32, thereby preventing the contact portion 22 and the elastic jointing portion 31 (including the fulcrum portion 32 and the elastic portion 34) of said second contact 15 from being raised upwardly (warped). As shown in FIG. 7A, said fixing portion 42 forms with the main body of the second piece 21 a substantially U-shape and fixed to the housing 12 in a manner embracing part of the housing 12. The position and size of said fixing portion 42 may be suitably designed in consideration of these functions, holding force and the like.

Said contact portion 22 is of a protruded shape for facilitating the contact with said flexible printed circuit board 80. Although the connection portion 24 is of a surface mounting type (SMT) as shown in FIG. 3B, it may be a dip type.

Said fulcrum portion 32, said elastic portion 34 and said pressure receiving portion 20 serve to achieve the following functions when a flexible printed circuit board 80 is inserted into the connector. After the flexible printed circuit board 80 has been inserted into a fitting opening 18 of said housing 12, when pushing portions 36 of said pivoting member 16 are pivotally moved between the connection portions 24 and the pressure receiving portions 20 of said second contacts 15, said pressure receiving portions 20 are raised by the pushing portions 36 so that the elastic portions 34 of said second contacts are tilted toward said contact portions 22 about the fulcrum portions 32 of said second contacts 15, thereby causing said contact portions 22 to be pushed against the flexible printed circuit board 80. The sizes, and shapes of said fulcrum portions 32, said elastic portions 34, and said pressure receiving portions 20 may be suitably designed so as to achieve such functions.

Moreover, the pressure receiving portion 20 of said second contact 15 is provided at its tip with the extended portion 26 as described above. When the pushing portions 36 of said pivoting member 16 are pivoted or pivotally moved between the pressure receiving portions 20 and the connection portions 24 of said second contacts 15, the center of said pivoting member 16 is often deformed in the direction shown by an arrow B in FIG. 1A due to strong reaction forces against the pivotal movement of said pivoting member 16. In this case, since the extended portions 26 engage anchoring holes 30 (later described) of the pivoting member 16, the deformation of the pivoting member 16 will be effectively prevented. The size of said extended portions 26 may be any one insofar as they can achieve the function described above, and may be suitably designed to an extent such that the pushing portions 36 of said pivoting member 16 can engage the extended portions 26. Moreover, said extended portions 26 serve to hold the pushing portions 36 of said pivoting member so as to prevent the pushing portions 36 from being tilted when said pivoting member has been completely pivotally moved and said contacts 14 have contacted the connecting object.

It is preferable to provide an extension portion 44 (not shown but like 441 in FIG. 6) extending from said fulcrum portion 32 in the opposite direction (toward the fitting opening 18) from said connection portion 24 of the second contact 14, although the extension portion is not provided in the illustrated embodiment. A flux rise can be prevented by providing the extension portion 44 and by suitably setting a relation between said extension portion 44 and said first piece 19 respectively and the inserting hole 38 of said housing 12. In other words, the first piece 19 of the second contact 15 is inserted in said inserting hole 38 with a clearance, but said extension portion 44 is inserted in said inserting hole 38 closely to an extent that a capillary phenomenon would occur. Therefore, the relation between said inserting hole 38 and said extension portion 44 closely inserted therein tends to cause a capillary phenomenon of the flux so that the flux flows along said extension portion 44 but does not flow upwardly toward said contact portion 22 where the capillary phenomenon does not occur. The length of said extension portions 44 may be suitably designed so as to perform the functions, and the extension portions may be sufficient to have a length of the order of 1.0 mm.

The locking member 171 will be explained with reference to FIG. 6. The locking members 171 are also made of a metal and formed by means of the press-working of the known technique. Preferred metals from which to form the locking members are similar to those of said first and second contacts 14 and 15.

Said locking member 171 comprises at least a first piece 191 having the engaging portion 56 at one end and a pressure receiving portion 201 at the other end, a second piece 211 having a connection portion 241 at its outer end, and an elastic jointing-portion 311 (consisting of a fulcrum portion 321 and an elastic portion 341) for jointing or connecting said first piece 191 and the remaining end of said second piece 211. Said elastic jointing-portion 311 includes the fulcrum portion 321 and the elastic portion 341 in the illustrated embodiment. In other words, the locking member 171 is substantially inverted h-shaped as shown in FIG. 6, and comprises the first piece 191 having at one end the engaging portion 56 adapted to engage the anchoring portion 82 of said flexible printed circuit board 80, at the other end the pressure receiving portion 201 to be pushed by said pivoting member 16, and an extended portion 261 inwardly extending from the tip of the pressure receiving portion 201, the second piece 211 having at one end the fulcrum portion 321 and at the other end the connection portion 241 to be connected to the substrate, the elastic portion 341 for jointing or connecting the substantially center of said first piece 191 and said fulcrum portion 321 of said second piece 211 (the elastic jointing-portion 311 consisting of said fulcrum portion 321 and said elastic portion 341), and a fixing portion 421 provided on said second piece 211 in the proximity of the elastic jointing-portion 311 and close to the main body of said second piece 211. In the illustrated embodiment, there is provided an extension portion 441 extending from said fulcrum portion 321 toward the fitting opening 18. The extension portion 441 extends from said fulcrum portion 321 to a substantially intermediate position between said elastic portion 341 and said engaging portion 56. Said engaging portion 56 of said first piece 191, said elastic portion 341, said fulcrum portion 321, and said connection portion 241 are arranged substantially in the form of a crank.

Said fixing portion 421 is provided on said second piece 211 in the proximity of said elastic jointing-portion 311 of said locking member 171 and close to the main body of the second piece 211. In other words, the fixing portion 421 is provided below and in the proximity of said fulcrum portion 32 to prevent the contact portion 22 and the elastic jointing-portion 31 (including the fulcrum portion 32 and the elastic portion 34) of the second contact 15 from being raised (warped). As shown in FIGS. 7B and 8B, the fixing portion 421 forms with the main body of the second piece 211 a U-shaped portion to embrace the part of the housing 12, whereby the ground member 17 (171) is fixed. The positions and size of said fixing portions 421 may be suitably designed taking into account such functions, holding forces and the like.

The engaging portion 56 of said locking member 171 is adapted to engage the anchoring portion 82 of the flexible printed circuit board 80 and contact said ground layer 86 to earth the ground layer so that the engaging portion 56 is of a protruded shape for facilitating the engagement and contact. Said connection portion 241 is of a surface mounting type (SMT) in the illustrated embodiment as shown in FIG. 6, but it may be a dip type. The shape and size of said engaging portion 56 may be suitably designed so as to permit a flat portion of said engaging portion 56 to engage said anchoring portion 82 and to contact said ground layer 86 upon the engagement of the engaging portion 56 of said locking member 171 and the anchoring portion 82 of said flexible printed circuit board 80, and in consideration of the strength of said locking member 171.

As is the case with said second contacts 14, after the flexible printed circuit board 80 has been inserted into the fitting opening 18 of the housing 12, when the pushing portions 36 of said pivoting member 16 are pivotally moved between the pressure receiving portions 201 and the connection portions 241 of said locking members 171, said pressure receiving portions 201 are raised by said pushing portions 36 so that the elastic portions 341 of said locking members 171 are tilted toward said engaging portions 56 about the fulcrum portions 321 of said locking members 171, thereby causing said engaging portions 56 to engage the anchoring portions 82 of the flexible printed circuit board 80. The sizes and shapes of said fulcrum portions 321, said elastic portions 341, and said pressure receiving portions 201 may be suitably designed so as to achieve such functions.

The pivoting member 16 will then be explained. The pivoting member 16 is formed from an electrically insulating plastic material by means of the injection molding of the known technique. The materials for the pivoting member 16 may be suitably selected taking into account dimensional stability, workability, manufacturing cost, and the like and generally include polybutylene terephthalate (PBT), polyamide (66PA or 46PA), liquid crystal polymer (LCP), polycarbonate (PC) and the like and combination thereof. Said pivoting member 16 mainly comprises an actuating portion 37, axles 28 adapted to be fitted in the housing 12 for pivotal movements, the pushing portions 36 for pushing the pressure receiving portions 20 of said contacts, and the anchoring holes 30 adapted to engage the extended portions 26 of said contacts. Said axles 28 are a fulcrum for pivotally moving the pivoting member 16 and are suitably fitted in both the longitudinal ends of the housing 12 to enable the pivotal movement of the pivoting member 16. Moreover, the pivoting member 16 is provided at both longitudinal ends with locking portions adapted to engage the housing 12 so as to prevent the pivoting member 16 from being raised (upwardly viewed in the drawing) when the pressure receiving portions 20 and 201 of said contacts and said locking members 171 are pushed by the pushing portions of the pivoting member. The shape and size of the locking portions may be any ones insofar as they can engage the housing and suitably designed in consideration of the function described above, the size, strength and the like of the connector 10.

Said pushing portions 36 are for pushing the pressure receiving portions 20 of said contacts. The pushing portions 36 are preferably of an elongated shape in cross-section, and elliptical in the illustrated embodiment. With such an elliptical shape, when the pivoting member is pivotally moved in the direction shown by an arrow "A" as shown in FIG. 1A so as to pivotally move its pushing portions 36 between the pressure receiving portions 20 and 201 and the connection portions 24 and 241 of said second contacts 15 and said locking members 171, the pressure receiving portions 20 and 201 of said second contacts 15 and said locking members 171 are moved upwardly with the aid of the variation in contact height of the pushing portions 36 owing to, for example, difference in major and minor axes of an ellipse so that the contact portions 22 of said second contacts 15 are forced against the flexible printed circuit board 80 and the engaging portions 56 of said locking members 171 are caused to engage the anchoring portions 82 of said flexible printed circuit board 80. The shape of the pushing portions 36 may be of any one so long as the pushing portions 36 can be pivotally moved between the pressure receiving portions 20 and 201 and the connection portions 24 and 241 of said second contacts 15 and said locking members 171, and the pressure receiving portions 20 and 201 of said second contacts 15 and said locking members 171 can be raised with the aid of the variation in contact height such as difference in major and minor axes of the elliptical cross-section of the pushing portions 36.

In order to prevent the center of the pivoting member 16 from being deformed in the direction shown by the arrow "B" in FIG. 1A owing to the strong reaction forces against the pivotal movement of the pivoting member 16 when it is pivotally moving, the pivoting member 16 is provided with the anchoring holes 30 independently from one another which are adapted to be engaged with the extended portions 26 of said second contacts 15. The anchoring holes 30 provided independently from one another will contribute to enhancing the strength of the pivoting member 16 and prevent the deformation of the pivoting member when it is pivotally moving.

Finally, the housing 12 will be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof.

Said housing 12 is formed with the inserting holes 38 into which a required number of contacts are installed by press-fitting, hooking (lancing), welding or the like.

The housing 12 is provided at both the longitudinal ends with bearings in which the axles of said pivoting member 16 are fitted to be pivotally moved. The shape and size of the bearings may be any ones so long as the axles of the pivoting member 16 are pivotally moved as described below and may be suitably designed taking into account the functions, and the strength, size and the like of the housing 12. Moreover, the housing 12 is provided at both the longitudinal ends with anchoring portions at locations corresponding to the locking portions of said pivoting member 16.

The housing 12 has a ceiling portion 23 for covering or insulating the contact portions 22 of the first pieces 19 of said second contacts 15, and the ceiling portion 23 is formed with protection walls 55 at least on both the ends for preventing the ceiling portion 23 from deforming upwardly when the connecting object is forced upwardly inadvertently. The term "protection wall" means the wall portion of an edge shape without being chamfered or inclined. In the illustrated embodiment, the protection walls 55 are provided only on both the ends on the ceiling potion of the fitting opening 18 of the housing 12. By providing the protection walls 55, however, the function and effect of guiding the connecting object such as the flexible printed circuit board 80 into the fitting opening 18 of the housing may be lost.

The area occupied by the connector 10 will be substantially determined by the size of the housing 12. Concerning the size of the housing 12, its longitudinal length (2 to 3 mm) is determined by a pitch of the contacts×the number of the contacts+lengths of both the ends, while its width is determined by a length of the first contact 14+a length of the second contact 15, and its height (0.9 mm at the minimum) is determined by the height of the second contacts+a thickness of a wall of the housing. The pitch of the contacts varies within a range of 0.5 to 2.54 mm. The number of the contacts depends on customer's requirements. The lengths of the first and second contacts 14 and 15 are determined by customer's requirements and mechanical characteristics.

As a method for guiding the connecting object such as the flexible printed circuit board 80 into said fitting opening 18, the tip end of said flexible printed circuit board 80 is conducted into the fitting opening 18 in a manner putting or applying it onto the lower face of the fitting opening 18 of said housing 12 shown in FIG. 1A (upper surfaces of the connection portions 24 of said first contacts 14), thereby easily guiding it into the fitting opening 18.

The inventors of the present application have ascertained the effects of said protection walls 55. Under a condition of the connector 10 with a flexible printed circuit board 80 inserted, the flexible printed circuit board 80 was pulled in a direction perpendicular to the connector in a tension testing machine (this condition corresponding to the condition that the printed circuit board is accidentally forced upwardly when the connector is used in its horizontal position). The results are shown in Table 1 below and a graph shown in FIG. 15. The "holding force" used herein is intended to mean the force at a moment when the contacts are disconnected from the flexible printed circuit board, while said flexible printed circuit board is being pulled in the vertical direction. The "prior art" connector used herein is the connector having the fitting opening of which ceiling portion is chamfered all over it without any protection wall 55. The "improved" connector 1 is the connector having the fitting opening of which ceiling portion is provided with protection walls only at both the ends (both the ends are not chamfered). The "improved" connector 2 is the connector having the fitting opening of which ceiling portion is provided with a protection wall 55 all over it.

TABLE 1

| | | Number of conductors | | | | | | | |
|---|---|---|---|---|---|---|---|---|---|
| | | 18 | | | | 27 | | | |
| | | Sample No. | | | | | | | |
| | | 1 | 2 | 3 | 4 | 1 | 2 | 3 | 4 |
| Prior art | | 3.6 N | 3.6 N | 4.1 N | 4.0 N | 4.2 N | 4.8 N | 4.6 N | 4.5 N |
| Improved connector with protection wall | Improved connector 2 (all over ceiling) | 9.1 N | 9.1 N | 8.8 N | 8.9 N | 9.1 N | 9.0 N | 9.0 N | 8.9 N |
| | Improved connector 1 (only at both ends) | 8.6 N | 8.2 N | 8.4 N | 8.5 N | 9.2 N | 8.8 N | 8.6 N | 9.1 N |
| Mean value of prior art | | 3.83 N | | | | 4.53 N | | | |
| Mean value of improved connector | Improved connector 2 (all over ceiling) | 8.98 N | | | | 9.00 N | | | |
| | Improved connector 1 (only at both ends) | 8.43 N | | | | 8.93 N | | | |

Figure 15:
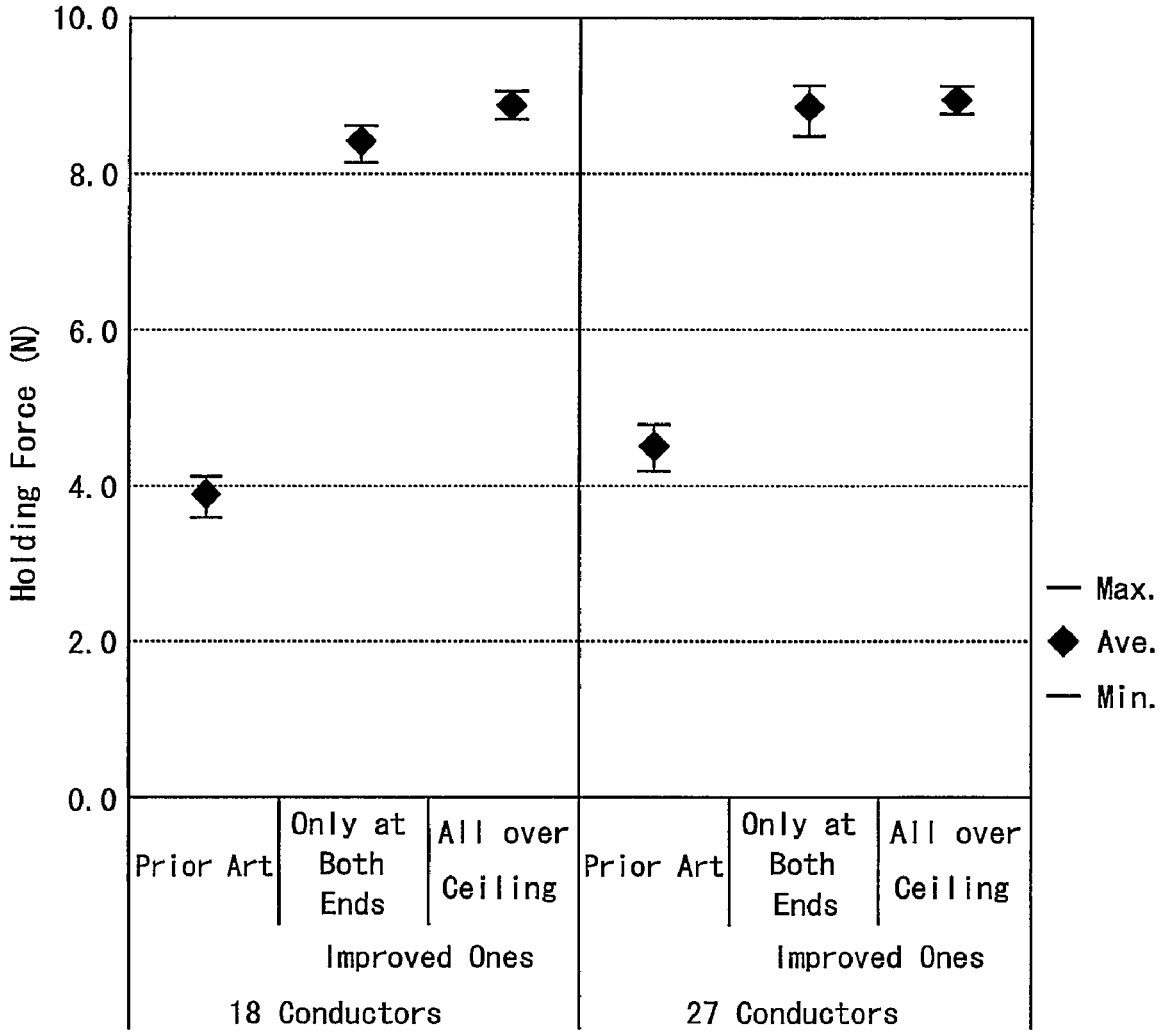
FIG. 15 is a graph illustrating how the holding force is increased by providing the protection walls according to the invention.
Figure 16:
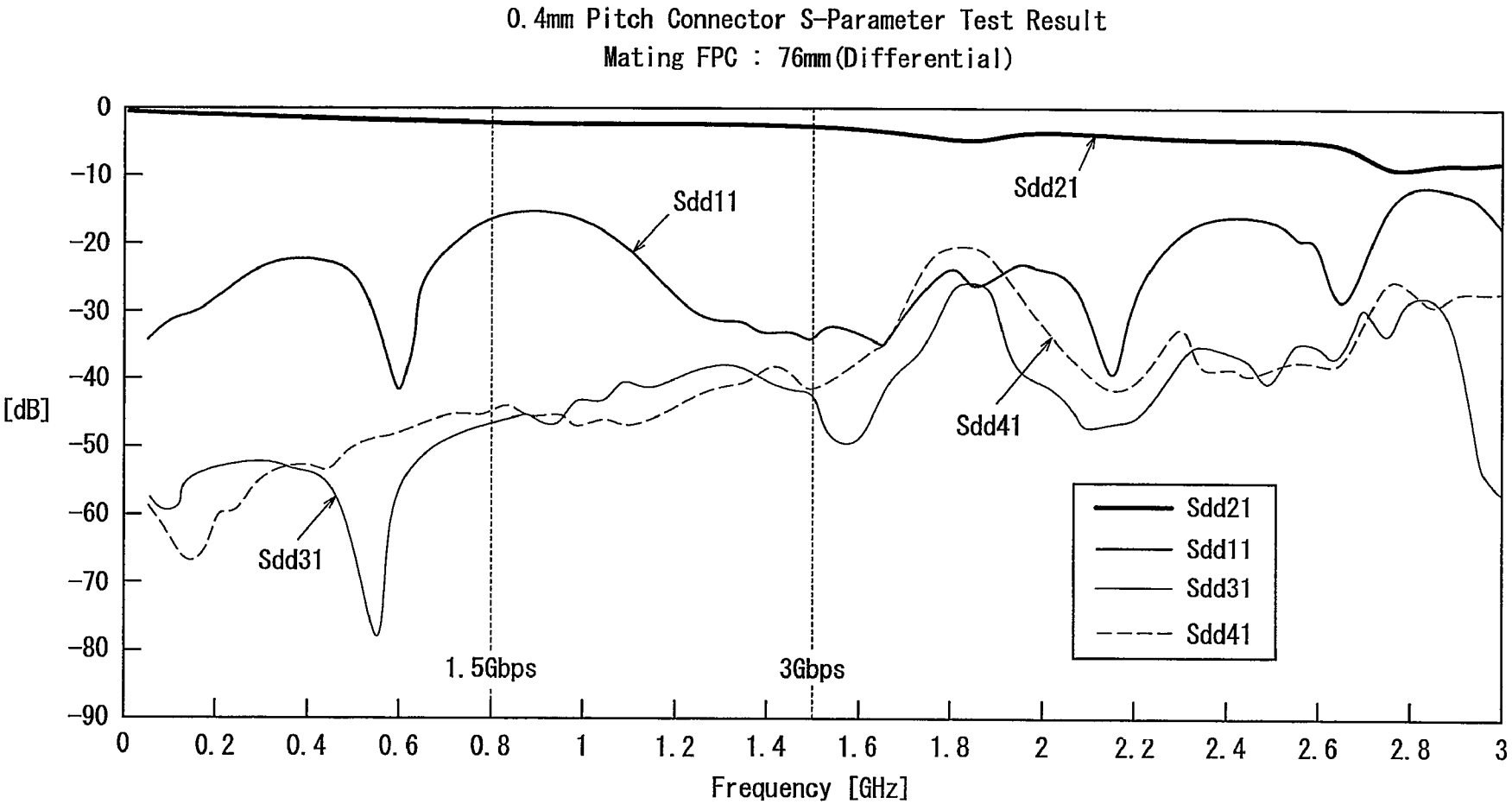
FIG. 16 is a graph illustrating S-parameters of combinations of hitherto used flexible printed circuit boards and connectors.
Figure 17:
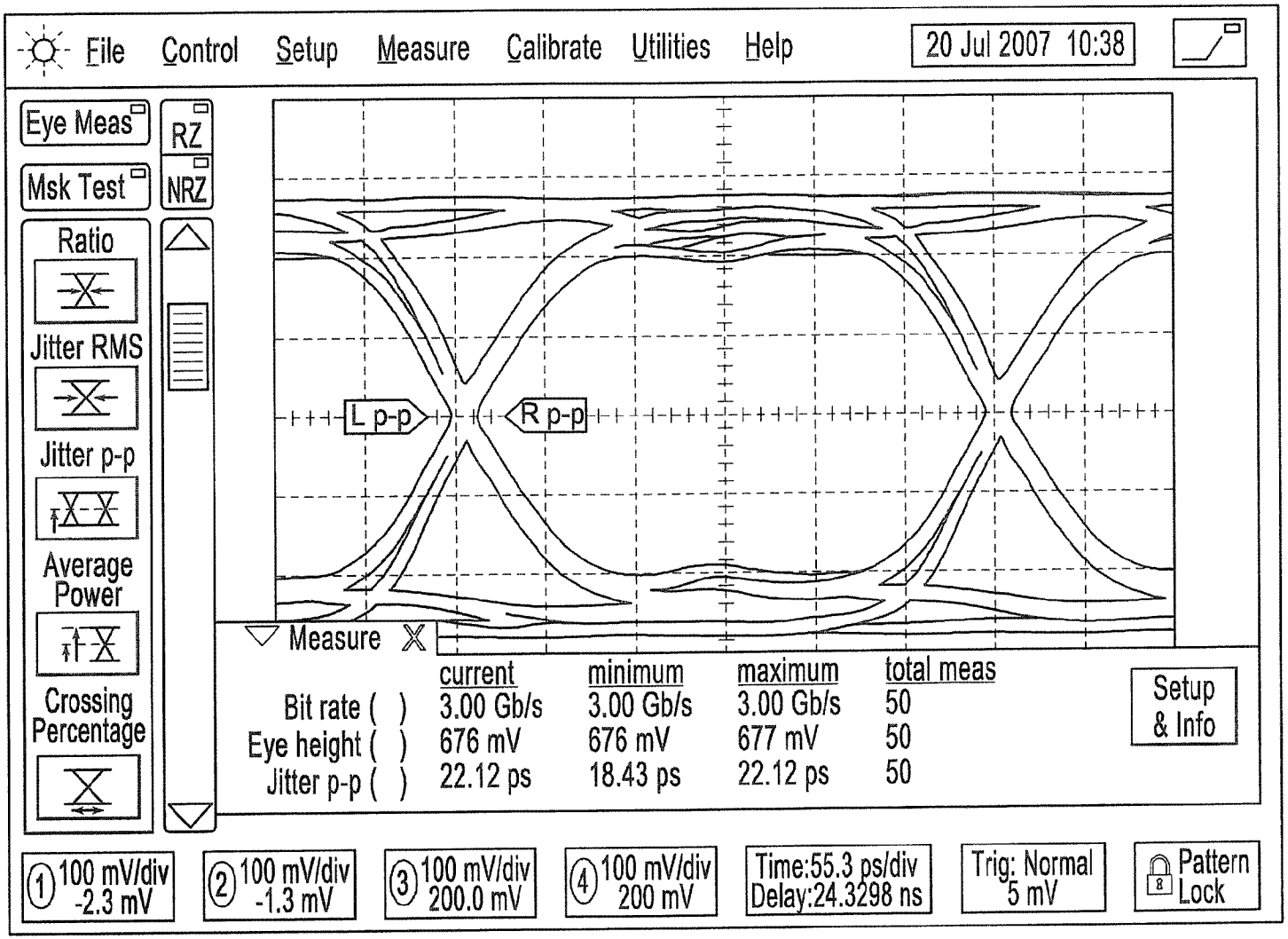
FIG. 17 is a graph of eye patterns of combinations of hitherto used flexible printed circuit boards and connectors.

Referring to the Table 1 and the graph of FIG. 15, with respect to the average or mean values, the holding forces (forces at disconnection of the contacts) of the improved connectors 1 (protection walls only at ends) and 2 (protection wall all over the ceiling portion) with 18 conductors increase to 8.4 N and 8.9 N, respectively, while the holding forces with 27 conductors increase to 8.9 N and 9.0 N, respectively. Accordingly, with the improved connectors, the holding forces are approximately twice those of the prior art connectors. As can be seen from these results, the holding forces (forces at disconnection of contacts) are remarkably increased by providing the protection wall all over or at both the ends of the inserting opening. In other words, by providing the protection walls all over or at both the ends of inserting opening, the holding forces signifying the contact stability between the contacts and the connecting object or flexible printed circuit board will increase to twice when being subjected to accidental external forces. This means increased stability for accidental external forces. It is also apparent that there is no large difference in holding forces (forces at disconnection of contacts) between the protection walls provided only at both the ends and all over the ceiling portion of the inserting opening. The improved percentages of holding forces are 220.3% with 18 conductors and 197.2% with 27 conductors. The improved percentage is the value obtained by dividing a holding force for an improved connector by a holding force for a prior art connector. The number of locations provided with the protection wall 55 is preferably as few as possible in consideration of the fact that there is no large difference in holding forces (forces at disconnection of contacts) between the protection walls 55 provided only at both the ends and provided all over the ceiling portion 23 of the inserting opening 18, and the prevention of the connecting object such as the flexible printed circuit board 80 from being scratched (damaged). In the illustrated embodiment, the protection walls are provided only both the ends of the ceiling portion of the inserting opening, however, it is preferable to provide the protection walls at three locations, that is, at the center and both the ends in view of balancing. In order to prevent the connecting object such as the flexible printed circuit board from being scratched (damaged), it is preferable to design the housing so that it does not contact the connecting object when the connecting object is accidentally subjected to an external force. For this purpose, it is considered to provide a chamfered portion, round chamfer, recessed chamfer or stepped recess. The chamfered portion is preferable taking into account esthetical quality, material cost and the like. With respect to the conducting the connecting object into the fitting opening 18, by employing the method described above, it is possible to conduct it sufficiently without chamfering the ceiling portion of the fitting opening.

The movement and pivotal movement of the pushing portions 36 of said pivoting member 16 will then be explained with reference to FIGS. 9A to 9E in which the pushing portion 36 is pivotally moved between the pressure receiving portion 20 and the connection portion 24 of the second contact 15 by way of example.

Figure 9A:
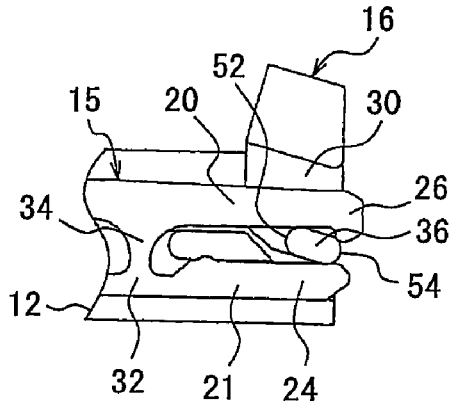
FIGS. 9A to 9E are explanatory views for explaining movements of a pushing portion and an axis of rotation when the pivoting member is being pivotally moved.

FIG. 9A illustrates the state that a connecting object or flexible printed circuit board 80 is not inserted into the connector 10. The lower end 54 of said pushing portion 36 is positioned between the extended portion 26 of said pressure receiving portion 20 and the connection portion 24 of the contact 15.

Figure 9B:
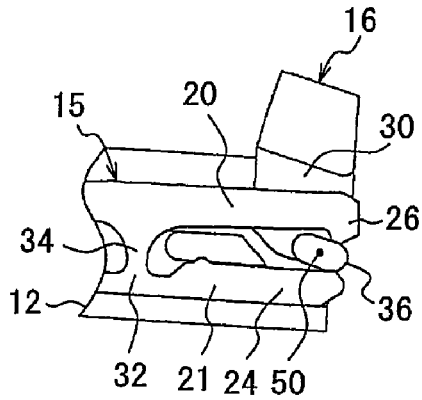

As shown in FIG. 9B, when said actuating portion 37 of the pivoting member 16 is pivotally moved (in the clockwise direction viewed in the drawing), the pushing portion 36 is moved in an opposite direction from the fitting opening 18 of the housing so that the lower end 54 of said pushing portion 36 is embraced between the extended portion 26 of said pressure receiving portion 20 and the connection portion 24.

Figure 9C:
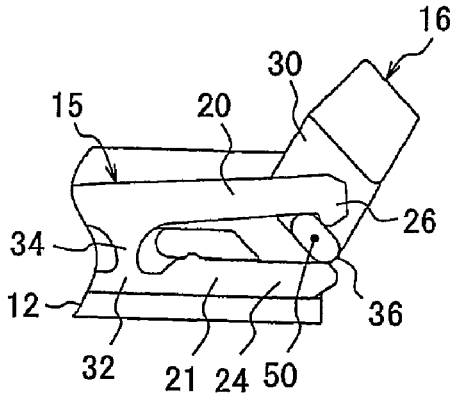

As shown in FIG. 9C, when the actuating portion 37 is further pivotally moved, said pushing portion 36 at its position shown in FIG. 9B is pivotally moved about the center of the pushing portion 36 as the rotational axis 50.

Figure 9D:
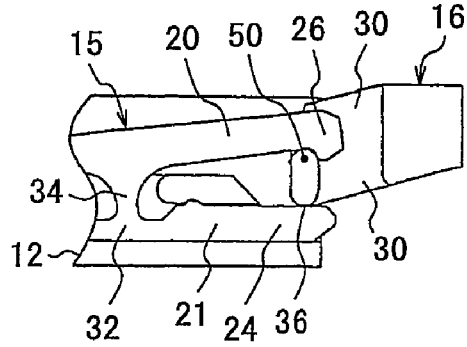

As shown in FIG. 9D, when said actuating portion 37 is further pivotally moved, the pushing portion 36 at its position shown in FIG. 9C is pivotally moved about the center of the pushing portion 36 as the rotational axis 50 so that the pushing portion 36 stands substantially upright between said pressure receiving portion 20 and said connection portion 24 and the rotational axis 50 is moved toward the upper end 52 in contact with the extended portion 26.

Figure 9E:
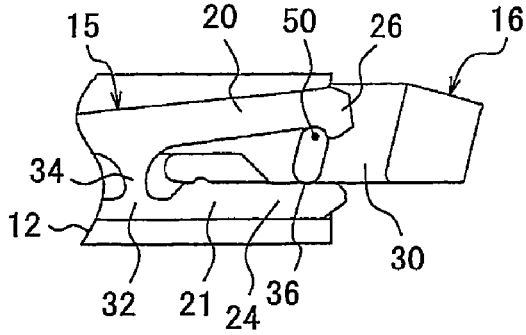

As shown in FIG. 9E, when the actuating portion 37 is further pivotally moved, the pushing portion 36 at its position shown in FIG. 9D is pivotally moved about a center in the proximity of the upper end 52 in contact with the extended portion 26 so that the pushing portion 36 engages the extended portion 26 in a manner that the pushing portion 36 is caught by the extended portion 26.

In other words, the pushing portion 36 is initially moved and then pivotally moved, and when the pushing portion 36 is further pivotally moved, the rotational axis 50 progressively changes or moves so that the pushing portion 36 performs its compact and space-saving pivotal movement or rotation.

In the connector 10 according to the invention, namely, first, when a connecting object such as the flexible printed circuit board 80 is inserted into the fitting opening 18 of the housing, a force is not required because of the so-called "zero-insertion force" type. Then, the pushing portions 36 of the pivoting member 16 are pivotally moved at a location closer to the extended portions 26 of said contacts 15 (to push the pressure receiving portions 20 of said contacts upwardly at a location closer to the extended portions 26) so that the pivoting member 16 can be locked with a slight force. Moreover, the pressure receiving portions 20 of said contacts are pushed upwardly by the pushing portions 36 of said pivoting member 16 at the location closer to the extended portions 26 so that a greater contact force can be obtained between the contacts and the connecting object or flexible printed circuit board.

Now, the relations will be explained between the size of said fitting opening 18 (distance between the upper surface 57 and the lower surface 58 of the fitting opening), the thickness of said flexible printed circuit board 80, and the contact portions 22 of the first and second contacts 14 and 15. Under the state that the flexible printed circuit board 80 has not been inserted into the fitting opening of the housing, the contact portions 22 of said second contacts 15 are in said inserting holes 38 without extending beyond the upper surface 57 of the fitting opening into the fitting opening 18. The contact portions 22 of said first contacts 14 extend beyond the lower surface 58 of the fitting opening into the fitting opening 18 so that the distance between the tips of the contact portions 22 of said first contacts 14 and the upper surface 57 of the fitting opening becomes smaller than the thickness of said flexible printed circuit board 80. In other words, under the state that the flexible printed circuit board 80 has been inserted into the fitting opening of the housing, the flexible printed circuit board 80 is always in contact with the contact portions 22 of said first contacts 14 to construct a structure ensuring a minimal contacting force. The same holds true in the case that the flexible printed circuit board 80 is accidentally subjected to an external force. Namely, in order to ensure the minimal contacting force even when the flexible printed circuit board 80 is accidentally subjected to an external force, suitably designed are the relations between the size of said fitting opening 18 (distance between the upper surface 57 and the lower surface 58 of the fitting opening), the thickness of said flexible printed circuit board 80, and the contact portions 22 of the first and second contacts 14 and 15.

In the illustrated embodiment, the anchoring portions 82 are used as the recessed portions 87 to be provided in the flexible printed circuit board 80, and the locking members 171 are used as the ground members 17 adapted to contact the ground layer 86 of said flexible printed circuit board 80 by way of example. However, said recessed portions 87 and said ground members 17 (171) may be any ones insofar as they fulfill the following facts.

First, said ground members 17 are constructed to be similar in construction to that of said second contacts 15. In other words, the ground members 17 are brought into contact with said ground layer 86 of the flexible printed circuit board 80 by pivotally moving said pivoting member 16.

Then, the positions of said recessed portions 87 are so determined that the recessed portions are inside the size of said housing 12 (within the area occupied by the connector 10) provided with the ground members 17 of the construction substantially the same as that of said second contacts 15 and do not contact the first and second contacts 14 and 15 and do not interfere with the pivotal movement of the pivoting member 16. The area occupied by the connector 10 will be substantially determined by the size of the housing 12. Concerning the size of the housing 12, its longitudinal length (2 to 3 mm) is determined by a pitch of the contacts×the number of the contacts+lengths of both the ends, while its width is determined by a length of the first contact 14+a length of the second contact 15, and its height (0.9 mm at the minimum) is determined by the height of the second contacts+a thickness of a wall of the housing.

Figure 12A:
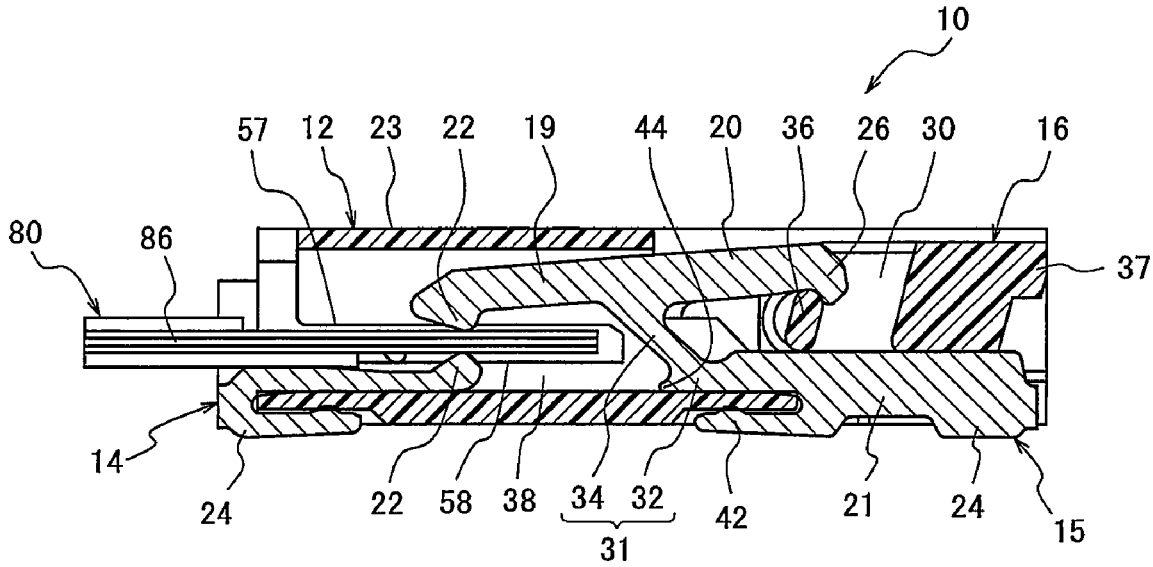
FIG. 12A is a sectional view of the connector with the pivoting member closed and with the flexible printed circuit board inserted, taken along one inserting hole for the contacts.
Figure 12B:
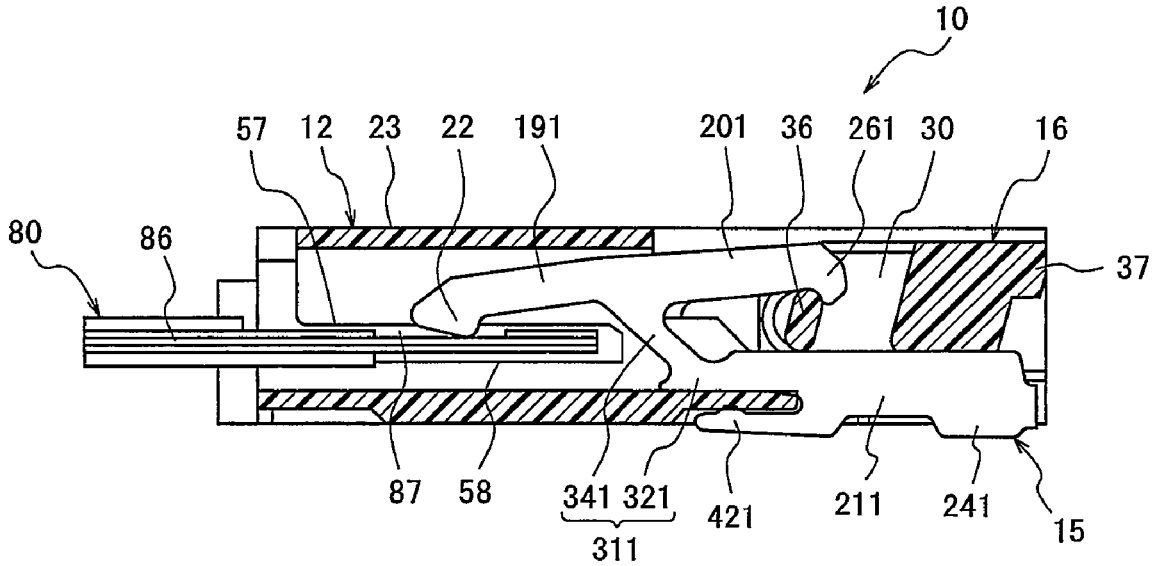
FIG. 12B is a sectional view of the connector with the pivoting member closed and with the flexible printed circuit board inserted, taken along one inserting hole for the member.

The ground members 17 will be explained with reference to FIG. 12B. The ground members 17 have a construction similar to that of said second contacts 15. By pivotally moving said pivoting member 16, the contact portion 22 of the ground member 17 is brought into contact with the ground layer 86 of the flexible printed circuit board 80. The tip of said contact portion 22 is flat in order that the tip of the contact portion 22 can easily contact the ground layer 86 and a stable contact therebetween can be obtained.

Figure 10A:
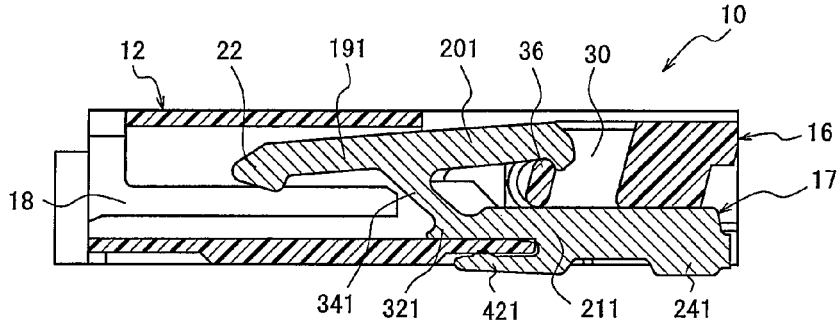
FIG. 10A is a sectional view of a connector using a member substantially the same in construction as that of the second contact.
Figure 10B:
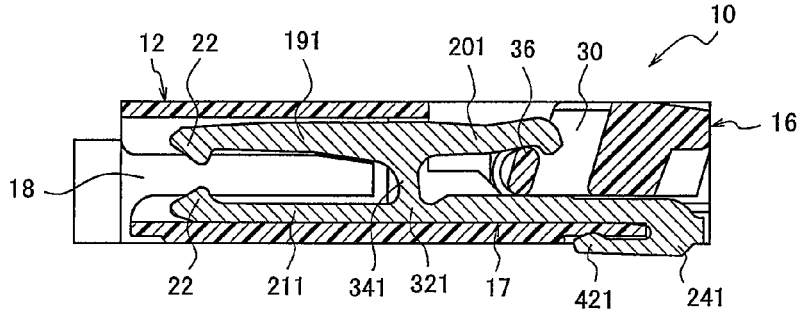
FIG. 10B is a sectional view of a connector using another member.
Figure 10C:
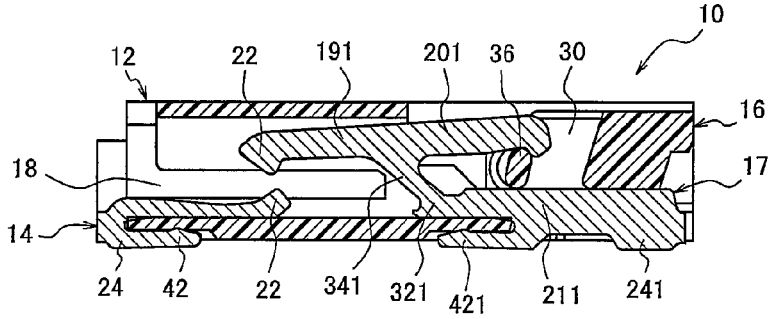
FIG. 10C is a sectional view of a connector using a first and a second member.
Figure 10D:
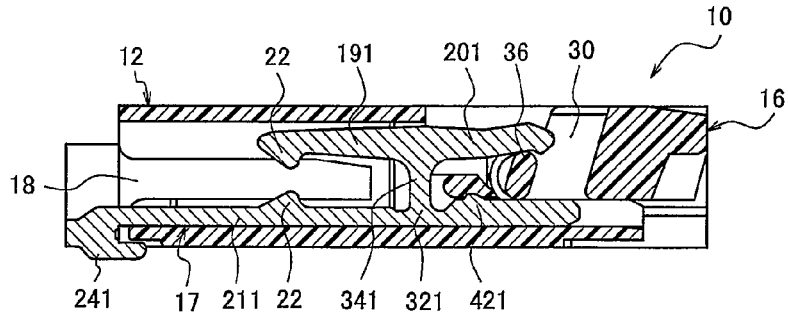
FIG. 10D is a sectional view of a connector using a different member.
Figure 11A:
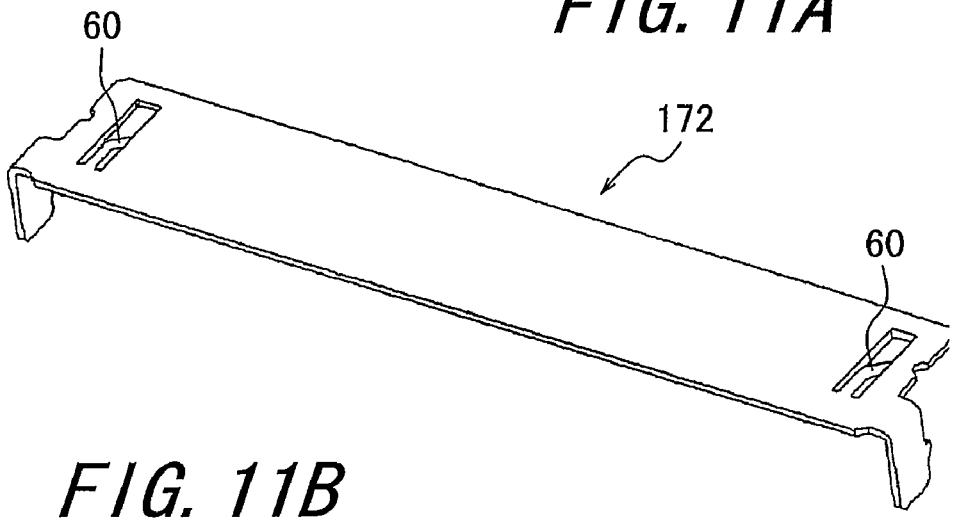
FIG. 11A is a perspective view of a shell used as the member.
Figure 11B:
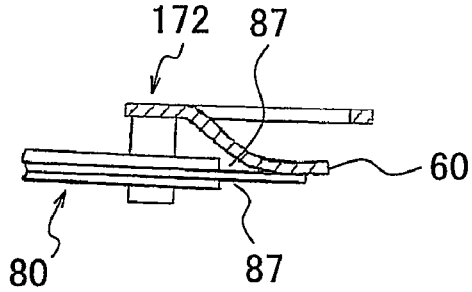
FIG. 11B is a partly sectional view of the shell shown in FIG. 11A.
Figure 11C:
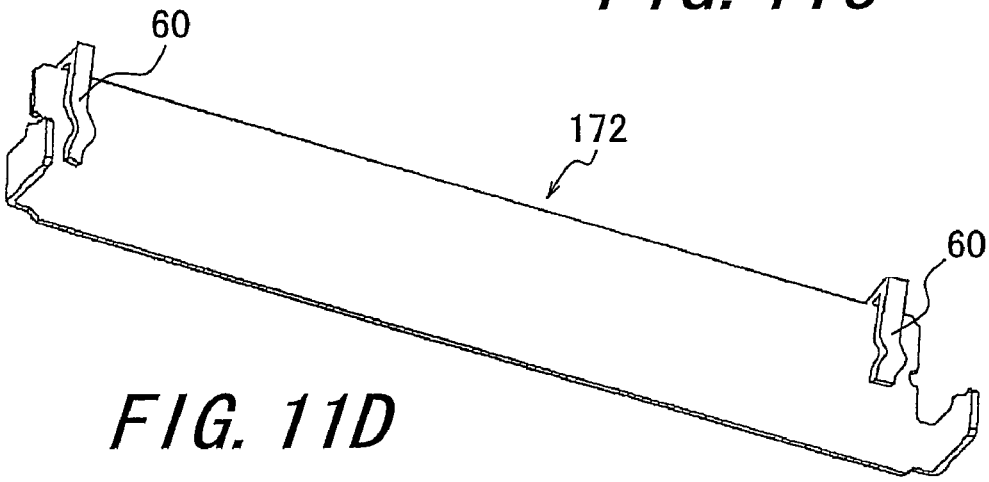
FIG. 11C is a perspective view of another shell used as the member.
Figure 11D:
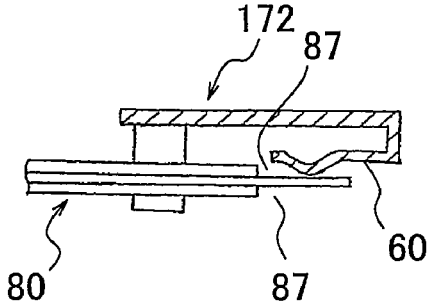
FIG. 11D is a partly sectional view of the shell shown in FIG. 11C.

Constructions of other members will be explained with reference to FIGS. 10A to 10D and FIGS. 11A to 11D. FIGS. 10A to 10D are sectional views of connectors taken along the respective members illustrating the members claimed in claims 5, 6, 7, and 8, respectively. FIG. 11A is a perspective view of a shell used as the member, and FIG. 11B is a partly sectional view of the proximity of an extended piece of the shell. FIG. 11C is a perspective view of another shell, and FIG. 11D is a partly sectional view of the proximity of an extended piece of the shell shown in FIG. 11C. The respective constructions of these members will be explained hereinafter.

The construction of the member shown in FIG. 10A will be explained. This construction is recited in claim 5, which is substantially the same as that of the second contact 15.

The construction of the member shown in FIG. 10B will be explained. This construction is recited in claim 6. The ground member 17 shown in FIG. 10B comprises a first piece 191 having at one end a contact portion 22 and at the other end a pressure receiving portion 201, a second piece 211 having at one end a contact portion 22 and at the other end a connection portion 241, an elastic jointing-portion 311 (consisting of a fulcrum portion 321 and an elastic portion 341) for jointing said first piece 191 and said second piece 211, and a fixing portion 421 for fixing the ground member 17 to said housing 12.

The construction of the member shown in FIG. 10C will be explained. This construction is recited in claim 7. As said ground member 17, a first member and a second member are used whose constructions are substantially the same as those of said first and second contacts 14 and 15, respectively so that either, or both, of the first and second members are brought into contact with said ground layer.

The construction shown in FIG. 10D will be explained. This construction is recited in claim 8. The ground member 17 shown in FIG. 10D comprises a first piece 191 having at one end a contact portion 22 and at the other end a pressure receiving portion 201, a second piece 211 having at one end a connection portion 241, an elastic jointing-portion 311 (consisting of a fulcrum portion 321 and an elastic portion 341) for jointing said first piece 191 and the other end of said second piece 211, and a fixing portion 421 for fixing the ground member 17 to the housing 12. In this embodiment, further there is provided an extension portion extending from the other end of said second piece 211 so as to be opposite to said pressure receiving portion 201 so that a pushing portion 36 of said pivoting member 16 is pivotally moved between said extension portion and said pressure receiving portion 201. Moreover, the second piece 211 is also provided with a contact portion 22 facing to the contact portion 22 of said first piece 191.

The construction of a shell used as the ground member will be explained with reference to FIGS. 11A to 11D. The shell 172 is made of a metal and formed by means of the press-working of the known technique. Preferred metals from which to form the shell 172 include brass, beryllium copper, phosphor bronze, and the like which comply with the requirements as to shield characteristics, springiness, electric conductivity, and the like.

The shell 172 comprises at least a fixing portion to be fixed to said housing 12 and extended pieces 60 adapted to contact exposed portions 87 of said flexible printed circuit board 80.

The construction shown in FIGS. 11A to 11D is recited in claim 9. As the ground member 17, the shell 172 is used which covers said housing 12 and is provided at given locations with extended pieces 60 which enter the exposed portions 87 and come into contact with said ground layer 86. Any construction of the extended pieces 60 may be employed so long as they can contact the exposed portions 87 of said flexible printed circuit board.

The extended pieces will be explained with reference to FIGS. 11A and 11B. The shell 172 is formed with substantially U-shaped slits, and the pieces surrounded by the U-shaped slits are raised away from the shell to form the extended pieces 60. In the illustrated embodiment, the extended pieces extend in the inserting direction of the flexible printed circuit board 80, but they may extend in the opposite direction.

The extended pieces shown in FIGS. 11C and 11D will be explained. The shell 172 is formed with substantially L-shaped extension portions as said extended pieces 60. Although the extended pieces 60 are L-shaped in the illustrated embodiment, they may be any shape insofar as they can contact the exposed portions 87 of the flexile printed circuit board 80. They may be each formed as a vertically extending straight member whose lower end is bent.

Figure 13A:
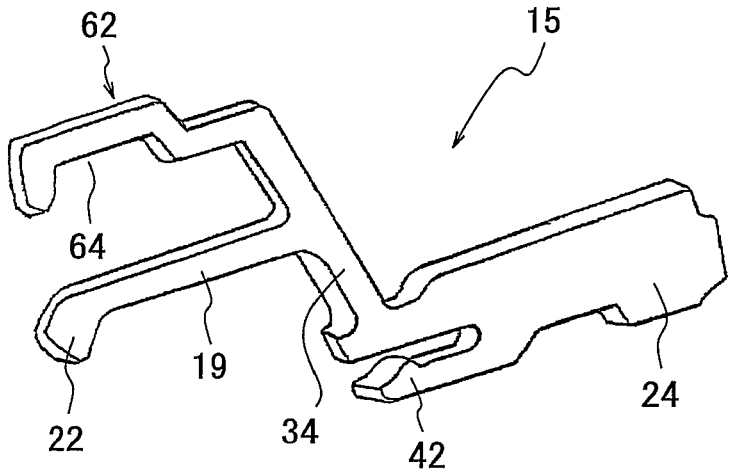
FIG. 13A is a perspective view of a second contact used in a front locking type connector (a pivoting member is pivotally moved on the side of fitting opening)
Figure 13B:
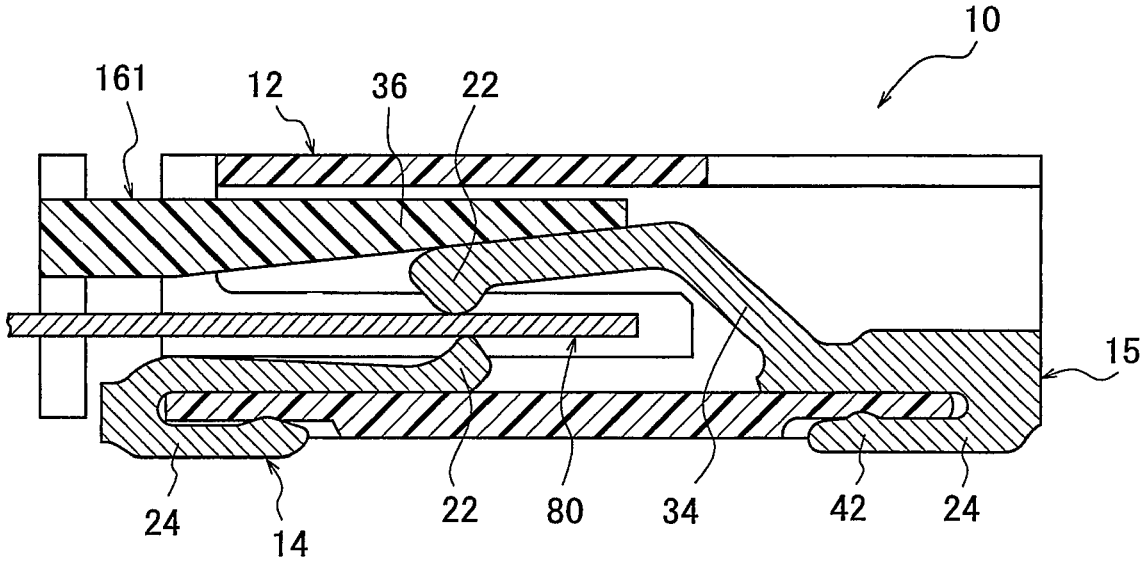
FIG. 13B is a sectional view of a slider type connector with a slider inserted.
Figure 14A:
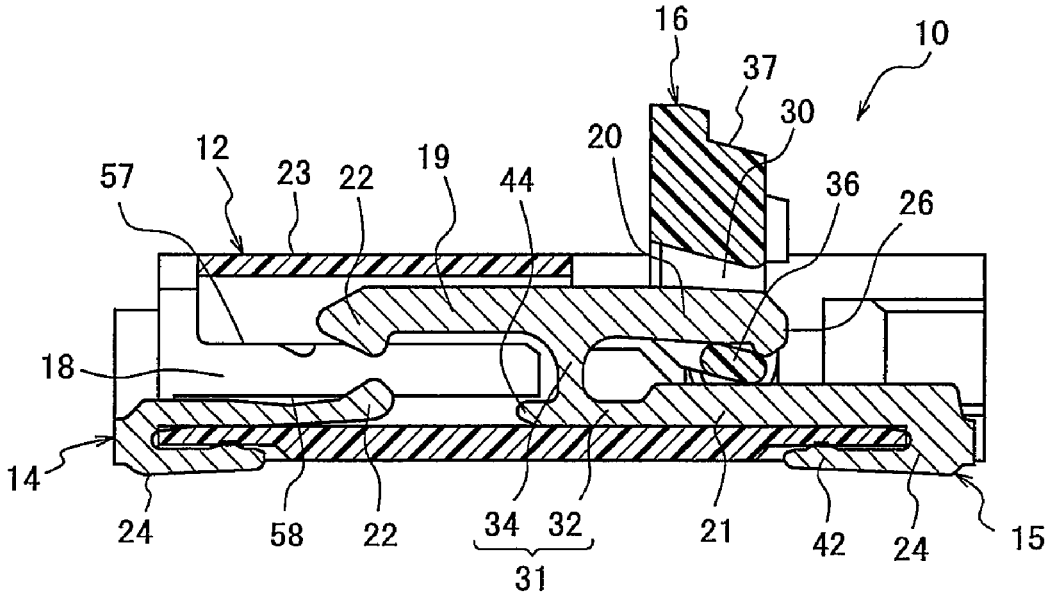
FIG. 14A PRIOR ART
FIG. 14A is a section view of the connector of the prior art with the pivoting member opened, taken along one inserting hole for contacts.
Figure 14B:
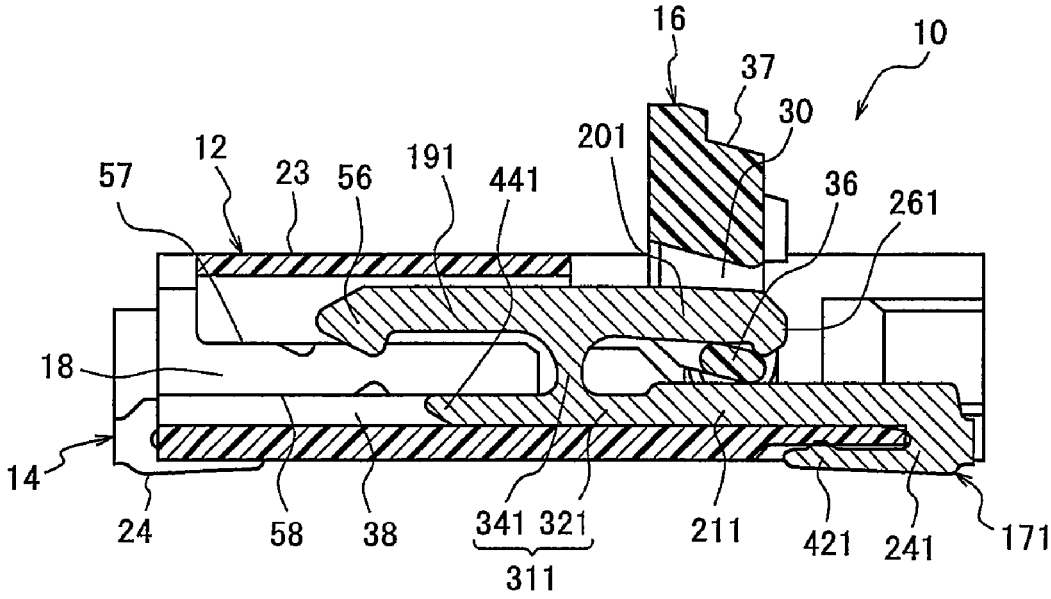
FIG. 14B PRIOR ART
FIG. 14B is a section view of the connector of the prior art with the pivoting member opened, taken along one inserting hole for a locking member.

Another connector will be explained with reference to FIGS. 13A and 13B. FIG. 13A is a perspective view of a second contact used in a front locking type connector (a pivoting member is pivotally moved on the side of a fitting opening). FIG. 13B is a sectional view of a slider type connector (an inserting member is inserted into the connector without using a pivoting member) with an inserting member inserted.

First, the front locking type connector (a pivoting member is pivotally moved on the side of a fitting opening) using the contacts as shown in FIG. 13A will be explained hereinafter. The construction of the connector 10 is recited in claim 3, which uses the contacts as shown in FIG. 13A which are different from the second contacts described above. The contacts used herein each comprise a first piece 19 having at one end a contact portion 22 and an extension piece 62 extending in parallel with the first piece 19 so that a pushing portion 36 of a pivoting member 16 is pivotally moved between the first piece 19 and the extension piece 62. It is desirable to provide a recess 64 in the extension piece 62 to cause the pushing portion 36 to be pivotally moved in the recess 64 in order to prevent the pushing portion 36 from coming out of contact with the first piece 19 and the extension piece 62 when the pivoting member 16 is being pivotally moved. The contact 15 shown in FIG. 13A is only by way of example, and may be of any construction so long as when the pivoting member 16 is pivotally moved on the side of the fitting opening 18, the contact portions 22 can be pushed to the flexible printed circuit board 80 and the circuit board 80 can be embraced between the contact portions 22 of the first and second contacts 14 and 15.

The slider type connector (an inserting member is inserted into the connector) shown in FIG. 13B will then be explained. The construction of the connector 10 shown in FIG. 13B is recited in claim 4. This connector 10 uses contacts as shown in FIG. 13B different from the second contacts described above and has a construction such that the inserting member 161 is inserted between the second contacts 15 and the housing 12. The construction of the connector described therein is only by way of example, and may be of any construction insofar as when the inserting member 161 is inserted into the connector from the side of the fitting opening 18, the contact portions 22 can be pushed to the flexible printed circuit board 80 and the circuit board 80 can be embraced between the contact portions 22 of the first and second contacts 14 and 15.

Examples of applications of the invention are connectors for use in mobile or cellular phones, notebook personal computers, digital cameras and the like, and more particularly to connectors enabling a miniaturization of the connector (high density of conductors) and simultaneously high speed transmission of signals by making it possible to bring the respective contacts into contact with contact portions of the flexible printed circuit board and at the same time to cause the members to contact the ground layer located between front and rear surfaces of the flexible printed circuit board by pivotally moving the pivoting member after the flexible printed circuit board has been inserted into the connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector device to be used with a flexible printed circuit board comprising a top and a bottom surface which is provided with a plurality of ground patterns, signal patterns and phase inversion signal patterns whose phases are inverted by respective pattern placement on both the top and bottom surfaces, and with a ground layer arranged between said top and bottom surfaces, said signal pattern and said phase inversion signal pattern being arranged between said ground patterns, and said flexible printed circuit board is provided at predetermined positions with exposed portions which exposing said ground layer at least from one side of its both surfaces, wherein said connector device including a required number of contacts each having a contact portion adapted to contact said flexible printed circuit board and a connection portion to be connected to a substrate, a required number of ground members at locations corresponding to said exposed portions, and a housing having inserting holes for arranging and holding said contacts and said ground members inserted therein and a fitting opening into which said flexible printed circuit board is inserted, and a pivoting member mounted on said housing on the side or opposite side of said fitting opening for elastically deforming said contacts and said ground members to push them to said flexible printed circuit board, wherein said contacts of said connector consist of first contacts and second contacts of two kinds, and one first contact and one second contact are arranged in one and the same inserting hole of said housing such that the contact portions of the first contact and the second contact are opposite to each other, and wherein when said pivoting member is pivotally moved said first contacts and said second contacts corresponding to the respective patterns come into contact with said flexible printed circuit board, and ground members located at predetermined positions enter said exposed portions so as to contact said ground layer.

2. A connector device to be used with a flexible printed circuit board comprising a top and a bottom surface which is provided with required numbers a plurality of ground patterns, signal patterns and phase inversion signal patterns whose phases are inverted by respective pattern placement on both the top and bottom surfaces, and with a ground layer arranged between said top and bottom surfaces, said signal pattern and said phase inversion signal pattern being arranged between said ground patterns, and said flexible printed circuit board is provided at predetermined positions with exposed portions which exposing said ground layer at least from one side of its both surfaces, wherein said connector device including a required number of contacts each having a contact portion adapted to contact said flexible printed circuit board and a connection portion to be connected to a substrate, a required number of ground members at locations corresponding to said exposed portions, and a housing having inserting holes for arranging and holding said contacts and said ground members inserted therein and a fitting opening into which said flexible printed circuit board is inserted, and an inserting member which is inserted into said fitting opening for elastically deforming said contacts and said ground members to push them to said flexible printed circuit board, wherein said contacts of said connector consist of first contacts and second contacts of two kinds, and one first contact and one second contact are arranged in one and the same inserting hole of said housing such that the contact portions of the first contact and the second contact are opposite to each other, wherein when said inserting member is inserted between said second contacts and housing and said second contacts corresponding to the respective patterns come into contact with said flexible printed circuit board, and ground members located at predetermined positions enter said exposed portions so as to contact said ground layer.

3. A connector device including a flexible printed circuit board comprising a top and a bottom surface which is formed with a number plurality of patterns on said top and bottom surfaces, and a connector, said connector including a required number of contacts each having a contact portion adapted to contact said flexible printed circuit board and a connection portion to be connected to a substrate, a housing having inserting holes for arranging and holding said contacts inserted therein and a fitting opening into which said flexible printed circuit board is inserted, and a pivoting member mounted on said housing on the side or opposite side of said fitting opening for elastically deforming said contacts to push them toward said flexible printed circuit board or an inserting member which is inserted into said fitting opening for elastically deforming said contacts to push them to said flexible printed circuit board, wherein said flexible printed circuit board is provided with required numbers of ground patterns, signal patterns and phase inversion signal patterns whose phases are inverted, and with a ground layer arranged between said top and bottom surfaces, said signal pattern and said phase inversion signal pattern being arranged between said ground patterns, and said flexible printed circuit board is provided at predetermined positions with exposed portions which reach said ground layer at least from the side of its one surface, wherein said contacts of said connector consist of first contacts and second contacts of two kinds, and one first contact and one second contact are arranged in one and the same inserting hole of said housing such that the contact portions of the first contact and the second contact are opposite to each other, and wherein when said pivoting member is pivotally moved or said inserting member is inserted into said connector, said first contacts and said second contacts corresponding to the respective patterns come into contact with said flexible printed circuit board, and said ground member is arranged in the position corresponding to said exposed portions of the predetermined position, said ground member enter in said exposed positions so as to contact said ground layer.

4. The connector device as claimed in claim 1 or 3, wherein said first contacts each comprise at one end the contact portion and at the other end the connection portion, wherein said second contacts each comprise a first piece having at one end the contact portion and at the other end a pressure receiving portion, a second piece having at one end the connection portion, an elastic jointing-portion for jointing said first piece and the remaining end of said second piece, and a fixing portion for fixing said second contact to said housing, and wherein said pivoting member comprises an actuating portion for pivotally moving said pivoting member, pushing portions provided continuously in the longitudinal direction of the pivoting member, and anchoring holes independent from one another for receiving therein said pressure receiving portions, respectively, and said pushing portions are pivotally movable between said pressure receiving portions and said connection portions of said second contacts.

5. The connector device as claimed in any one of claims 1 to 3, wherein said second contacts each comprise a first piece having at one end the contact portion, and an extension piece extending in parallel with said first piece so that said pushing portions of said pivoting member are pivotally movable between said first pieces and said extension pieces.

6. The connector device as claimed in any one of claims 1 to 3, wherein the connector having contacts with pitch of less than 0.2 mm.

7. The connector device as claimed in any one of claims 1 to 3, wherein the connector device is able to be used for signal transmission speed over 3 Gbps.

8. The connector device as claimed in any one of claims 1 to 3, wherein said ground members are each constructed substantially in the same construction as that of said second contacts.

9. The connector device as claimed in any one of claims 1 to 3, wherein said ground members each comprise a first piece having at one end a contact portion and at the other end a pressure receiving portion, a second piece having at one end a contact portion and at the other end a connection portion, an elastic jointing-portion for jointing said first piece and said second piece, and a fixing portion for fixing said ground member to said housing.

10. The connector device as claimed in any one of claims 1 to 3, wherein said ground members each consist of a first member and a second member having substantially the same constructions as those of said first contact and said second contact, respectively, so that either, or both, of the first and second members are brought into contact with said ground layer.

11. The connector device as claimed in any one of claims 1 to 3, wherein said ground members each comprise a first piece having at one end a contact portion and at the other end a pressure receiving portion, a second piece having at one end a connection portion, an elastic jointing-portion for jointing said first piece and the remaining end of said second piece, and a fixing portion for fixing said member to said housing.

12. The connector device as claimed in any one of claims 1 to 3, wherein said ground members are formed as a shell covering said housing, said shell being provided at predetermined positions with extended pieces which enter said exposed portions of said flexible printed circuit board and come into contact with said ground layer.

13. The connector device as claimed in any one of claims 1 to 3, wherein when said pushing portions of said pivoting member are pivotally moved between said pressure receiving portions and connection portions of said second contacts and said members or between said pressure receiving portions and said housing, rotational axes of said pushing portions progressively move so that the pushing portions perform their compact rotations, and wherein the fixing portions of said second contacts and said ground members are each provided on said second piece in the proximity of said elastic jointing-portion, thereby preventing said second contacts and said ground members from being warped when said pivoting member is being pivotally moved.

14. The connector device as claimed in any one of claims 1 to 3, wherein said flexible printed circuit board is provided with anchoring portions on both sides in its width direction, and locking members each having an engaging portion adapted to engage said anchoring portion are installed in said housing, said locking members each comprising a first piece having at one end the engaging portion and at the other end a pressure receiving portion, a second piece having at one end a connection portion, and an elastic jointing-portion for jointing said first piece and the remaining end of said second piece.

15. The connector device as claimed in any one of claims 1 to 3, wherein said flexible printed circuit board is provided on both sides in its width direction with anchoring portions which are used as said exposed portions, and said locking members are used as said ground members, and wherein said engaging portions of said locking members are brought into engagement with the anchoring portions of said flexible printed circuit board to cause said locking members to contact said ground layer.

16. connector device as claimed in any one of claims 1 to 3, wherein under a state that said flexible printed circuit board is not inserted into said connector, the contact portions of said second contacts are in said inserting holes without extending into said fitting opening beyond the upper surface of said fitting opening, and the contact portions of said first contacts extend into said fitting opening beyond the lower surface of said fitting opening so that the distance between tips of the.

contact portions of said first contacts and the upper surface of said fitting opening is smaller than the thickness of said flexible printed circuit board, and wherein under a state that said flexible printed circuit board has been inserted into said fitting opening and said pivoting member has been pivotally moved, said flexible printed circuit board remains in contact with the contact portions of said first contacts without said flexible printed circuit being raised upwardly beyond the upper surface of the fitting opening of said housing even when said flexible printed circuit board is accidentally subjected to an external force.

* * * * *